US007319185B1

(12) United States Patent
Wieder

(10) Patent No.: US 7,319,185 B1
(45) Date of Patent: Jan. 15, 2008

(54) GENERATING MUSIC AND SOUND THAT VARIES FROM PLAYBACK TO PLAYBACK

(76) Inventor: James W. Wieder, 4276 Hermitage Dr., Ellicott City, MD (US) 21042

( * ) Notice: Subject to any disclaimer, the term of this patent is extended or adjusted under 35 U.S.C. 154(b) by 590 days.

(21) Appl. No.: 10/654,000

(22) Filed: Sep. 4, 2003

Related U.S. Application Data

(63) Continuation-in-part of application No. 10/012,732, filed on Nov. 6, 2001, now Pat. No. 6,683,241.

(51) Int. Cl.
*G04B 13/00* (2006.01)
*G10H 7/00* (2006.01)

(52) U.S. Cl. ..... 84/609; 84/610; 84/634; 84/649; 84/650; 84/666

(58) Field of Classification Search ..... None
See application file for complete search history.

(56) References Cited

U.S. PATENT DOCUMENTS 4,787,073 A 11/1988 Masaki
5,281,754 A 1/1994 Farrett et al.
5,315,057 A 5/1994 Land et al.
5,350,880 A 9/1994 Sato
5,496,962 A 3/1996 Meier et al.
5,663,517 A * 9/1997 Oppenheim ..... 84/649
5,693,902 A 12/1997 Hufford et al.
5,728,962 A 3/1998 Goede
5,808,222 A * 9/1998 Yang ..... 84/603
5,952,598 A 9/1999 Goede
5,973,255 A 10/1999 Tanji
6,051,770 A 4/2000 Milburn et al.
6,093,880 A 7/2000 Arnalds
6,121,533 A 9/2000 Kay
6,150,598 A * 11/2000 Suzuki et al. ..... 84/603

(Continued)

OTHER PUBLICATIONS

"32 & 16 Years Ago (Jul. 1991)"; Neville Holmes (editor); IEEE Computer; Jul. 2007; p. 9. Applicant noticed this article while reading the IEEE Computer, Jul. 2007 issue. This article refers to the following 3 references that were published in the IEEE Computer, Jul. 1991 issue.

(Continued)

*Primary Examiner*—Marlon Fletcher
(74) *Attorney, Agent, or Firm*—James W. Wieder

(57) ABSTRACT

A method and apparatus for the creation and playback of music, audio and sound; such that each time a composition is played back, a different sound sequence is generated in the manner previously defined by the artist. During composition creation, the artist's definition of how the composition will vary from playback to playback is embedded into the composition data set. During playback, the composition data set is processed by a playback device incorporating a playback program, so that each time the composition is played back a unique version is generated. Variability occurs during playback per the artist's composition data set, which specifies: the spawning of group(s) from a snippet; the selection of snippet(s) from each group; editing of snippets; flexible and variable placement of snippets; and the combining and/or mixing of multiple snippets to generate each time sample in one or more channels. MIDI-like variable compositions and the variable use of segments comprised of MIDI-like command sequences are also disclosed.

55 Claims, 22 Drawing Sheets

U.S. PATENT DOCUMENTS

| | | | | |
|---|---|---|---|---|
| 6,153,821 | A | 11/2000 | Fay et al. | |
| 6,169,242 | B1 | 1/2001 | Fay et al. | |
| 6,215,059 | B1 * | 4/2001 | Rauchi et al. | 84/611 |
| 6,230,140 | B1 | 5/2001 | Severson et al. | |
| 6,255,576 | B1 * | 7/2001 | Suzuki et al. | 84/604 |
| 6,281,420 | B1 | 8/2001 | Suzuki et al. | |
| 6,281,421 | B1 | 8/2001 | Kawaguchi | |
| 6,316,710 | B1 * | 11/2001 | Lindemann | 84/609 |
| 6,320,111 | B1 | 11/2001 | Kizaki | |
| 6,362,409 | B1 | 3/2002 | Gadre | |
| 6,410,837 | B2 * | 6/2002 | Tsutsumi | 84/604 |
| 6,433,266 | B1 | 8/2002 | Fay et al. | |
| 6,448,485 | B1 | 9/2002 | Barile | |
| 6,609,096 | B1 * | 8/2003 | De Bonet et al. | 704/500 |
| 6,686,531 | B1 | 2/2004 | Pennock et al. | |
| 7,078,607 | B2 | 7/2006 | Alferness | |
| 2001/0039872 | A1 | 11/2001 | Cliff | |
| 2002/0166440 | A1 * | 11/2002 | Herberger et al. | 84/625 |
| 2003/0174845 | A1 * | 9/2003 | Hagiwara | 381/17 |
| 2004/0112202 | A1 | 6/2004 | Smith et al. | |

OTHER PUBLICATIONS

"Recombinant Music"; David Cope; IEEE Computer; Jul. 1991; pp. 22-28.

"Algorithms for Musical Composition: A Question of Granularity"; Steven Smoliar; IEEE Computer; Jul. 1991; pp. 54-56.

"Computer-Generated Music"; Dennis Baggi; IEEE Computer; Jul. 1991; pp. 6-9.

* cited by examiner

Legend:

Optional Elements (Select between Optional Elements)

Figure 17.

| Disadvantage | Overcome by |
|---|---|
| Composition definition is larger to store and download. | Storage & bandwidth cost decreasing at > 1.5x per year. |
| Requires more processing. | Processing costs decreasing by 1.5x per year. |
| Greater start-up delay. | Pipeline playback. Use faster processor. |
| Data is more sensitive to storage or bandwidth errors. | Sensitivity is similar to software. Use Error correction. |
| More effort for artists to create a composition. | Use visually driven composition creation software. |
| Artist's snippets could be used by others without authorization. | Use encryption. |

GENERATING MUSIC AND SOUND THAT VARIES FROM PLAYBACK TO PLAYBACK

CROSS REFERENCE TO RELATED APPLICATIONS

This application is a continuation-in-part of U.S. application Ser. No. 10/012,732, filed Nov. 6, 2001 now U.S. Pat. No. 6,683,241, entitled "Pseudo-Live Music and Audio". This earlier application is incorporated by reference herein.

COPYRIGHT STATEMENT

©2003 James W. Wieder. A portion of the disclosure of this patent document contains material that is subject to copyright protection. The copyright owner has no objection to the facsimile reproduction of the patent disclosure by any one, as it appears in the Patent and Trademark Office patent files or records, but otherwise reserves all copyright rights whatsoever.

BACKGROUND OF INVENTION

Current methods for the creation and playback of recording-industry music are fixed and static. Each time an artist's composition is played back, it sounds essentially identical.

Since Thomas Edison's invention of the phonograph, much effort has been expended on improving the exactness of "static" recordings. Examples of static music in use today include the playback of music on records, analog and digital tapes, compact discs, DVD's and MP3. Common to all these approaches is that on playback, the listener is exposed to the same audio experience every time the composition is played.

A significant disadvantage of static music is that listeners strongly prefer the freshness of live performances. Static music falls significantly short compared with the experience of a live performance.

Another disadvantage of static music is that compositions often lose their emotional resonance and psychological freshness after being heard a certain number of times. The listener ultimately loses interest in the composition and eventually tries to avoid it, until a sufficient time has passed for it to again become psychologically interesting. To some listeners, continued exposure, could be considered to be offensive and a form of brainwashing. The number of times that a composition maintains its psychological freshness depends on the individual listener and the complexity of the composition. Generally, the greater the complexity of the composition, the longer it maintains its psychological freshness.

Another disadvantage of static music is that an artist's composition is limited to a single fixed and unchanging version. The artist is unable to incorporate spontaneous creative effects associated with live performances into their static compositions. This imposes is a significant limitation on the creativity of the artist compared with live music.

And finally, "variety is the spice of life". Nature such as sky, light, sounds, trees and flowers are continually changing through out the day and from day to day. Fundamentally, humans are not intended to hear the same identical thing again and again.

The following is a discussion of the prior art that have employed techniques to reduce the repetitiveness of music instruments, sound and sound effects.

U.S. Pat. No. 4,787,073 by Masaki describes a method for randomly selecting the playing order of the songs on one or more storage disks. The disadvantage of this invention is that it is limited to the order that songs are played. When a song is played it always sounds the same.

U.S. Pat. No. 5,350,880 by Sato describes a demo mode (for a keyboard instrument) using a fixed sequence of "n" static versions. Each of the "n" versions are different from each other, but each individual version sounds exactly the same each time it is played and the "n" versions are always played in the same order. Hence, the complete sequence of the "n" versions always sounds the same and this same sequence is repeated again and again (looped-on), until the listener switches the demo "off". Basically, Sato has only increased the length of an unchanging, fixed sequence by "n", which is somewhat useful when looping. But, the listener is exposed to the same sound sequence (now "n" times longer) every time the demo is played and looped. Additional limitations include: 1) Unable to playback one version per play. 2) Does not end on it's own since user action is required to stop the looping. 3) Limited to a sequence of synthetically generated tones.

Another group of prior art deals with dynamically changing music in response to events and actions during interactive computer/video games. Examples are U.S. Pat. No. 5,315,057 by Land and U.S. Pat. No. 6,153,821 by Fay. A major objective here is to coordinate different music to different game conditions and user actions. Using user actions to provide a real-time stimulus in-order to change the music played is a desirable feature for an interactive game. Some disadvantages of this invention are: 1) It's not automatic since it requires user actions. 2) Requires real-time stimulus based on user actions and game conditions to generate the music 3) The variability is determined by the game conditions and user actions rather than by the artists definition of playback variability 4) The sound is generated by synthetic methods which are significantly inferior to humanly created musical compositions.

Another group of prior art deals with the creation and synthesis of music compositions automatically by computer or computer algorithm. An example is U.S. Pat. No. 5,496,962 by Meier, et al. A very significant disadvantage of this type approach is the reliance on a computer or algorithm that is somehow infused with the creative, emotional and psychological understanding equivalent to that of recording artists. A second disadvantage is that the artist has been removed from the process, without ultimate control over the creation that the listener experiences. Additional disadvantages include the use of synthetic means and the lack of artist participation and experimentation during the creation process.

Tsutsumi U.S. Pat. No. 6,410,837 discloses a remix apparatus/method (for keyboard type instrument) capable of generating new musical tone pattern data. It's not automatic, as it requires a significant amount of manual selection by the user. For each set of user selections only one fixed version is generated. This invention slices up a music composition into pieces (based on a template that the user manually selects), and then re-orders the sliced up pieces based on another template the user selects. Chopping up a musical piece and then re-ordering it, will not provide a sufficiently pleasing result for sophisticated compositions. The limitations of Tsutsumi include: 1) It's not automatic. Requires a significant amount of user manual selection via control knobs 2) For each set of user selections only one fixed version is generated 3) Uses a simple re-ordering of segments that are sliced up from a single user selected source piece of music 4) Limited to simple concatenation. One segment follows another 5) No mixing of multiple tracks.

Kawaguchi U.S. Pat. No. 6,281,421 discloses a remix apparatus/method (for keyboard type instrument) capable of generating new musical tone pattern data. It's not automatic as it requires a significant amount of manual selection by the user. Some aspects of this invention use random selection to generate a varying playback, but these are limited to randomly selecting among the sliced segments of the original that have a defined length. The approach is similar to slicing up a composition into pieces, and then re-ordering the sliced up pieces randomly or partially randomly. This will not provide a sufficiently pleasing result with recording industry compositions. The amount of randomness is too large and the artist does not have enough control over the playback variability. The limitations of Kawaguchi include: 1) It's not automatic. Requires a significant amount of user manual selection via control knobs 2) Uses a simple re-ordering of segments that are sliced up from a single user selected source piece of music 3) Limited to simple concatenation. One segment follows another 4) No mixing of multiple tracks.

Severson U.S. Pat. No. 6,230,140 describes method/apparatus for generating continuous sound effects. The sound segments are played back, one after another to form a long and continuous sound effect. Segments may be played back in random, statistical or logical order. Segments are defined so that the beginning of possible following segments will match with the ending of all possible previous segments. Some disadvantages of this invention include: 1) Due to excessive unpredictability in the selection of groups, artists have incomplete control of the playback timeline 2) A simple concatenation is used, one segment follows another segment 3) Concatenation only occurs at/near segment boundaries 4) There is no mechanism to position and overlay segments finely in time 5) No provision for the synchronization and mixing of multiple tracks. 6) No provision for multiple channels 7) No provision for inter-channel dependency or complimentary effects between channels 8) The concatenation result may vary with task complexity, processor speed, processor multi-tasking, etc 9) A sequence of the type instructions disclosed will not be compatible with multiple compositions 10) The user must take action to stop the sound from continuing indefinitely (continuously).

All of this prior art has significant disadvantages and limitations, largely because these inventions were not directed toward the creation and playback of artist-defined variable playback compositions.

SUMMARY OF INVENTION

During composition creation, the artist's definition of how the composition will vary from playback to playback is embedded into the composition data set. During playback, the composition data set is processed, without requiring listener action, by a playback program incorporated into a playback device so that each time the composition is played back a unique version is generated.

Accordingly, several objects and advantages of my invention over the static playback methods in use today include:

1) Each time an artist's composition is played back, a unique musical version is generated.

2) Does not require listener action, during playback, to obtain the variability and "aliveness".

3) Allows the artist to create a composition that more closely approximates live music.

4) Provides new creative dimensions to the artist via playback variability.

5) Allows the artist to use playback variability to increase the depth of the listener's experience.

6) Increases the psychological complexity of an artist's composition.

7) Allows listeners to experience psychological freshness over a greater number of playbacks. Listeners are less likely to become tired of a composition.

8) Playback variability can be used as a teaching tool (for example, learning a language or music appreciation).

9) The artist has complete control of the nature of the "aliveness" in their creation. The composition is embedded with the artist's definition of how the composition varies from playback to playback. (It's not randomly generated).

10) Artists create the composition through experimentation and creativity (It's not synthetically generated).

11) Allow simultaneous advancement in different areas of expertise. a) The creative use of a playback variability by artists. b) The advancement of the playback programs by technologists. c) The advancement of the "variable composition" creation tools by technologists.

12) Allow the development costs of composition creation tools and playback programs to be amortized over a large number of variable compositions.

13) New and improved playback programs can be continually accommodated without impacting previously released pseudo-live compositions (i.e., allow backward compatibility).

14) Generate multiple channels of sound (e.g., stereo or quad). Artists can create complementary variability effects across multiple channels.

15) Compatible with the studio recording process and special effects editing used by today's recording industry.

16) Each composition definition is digital data of fixed and known size in a known format.

17) The composition data and playback program can be stored and distributed on any conventional digital storage mechanism (such as disk or memory) and can be broadcast or transmitted across networks (such as, airwaves, wireless networks or Internet).

18) Compositions can be played on a wide range of hardware and systems including dedicated players, portable devices, personal computers and web browsers.

19) Pseudo-live playback devices can be configured to playback both existing "static" compositions and pseudo-live compositions. This facilitates a gradual transition by the recording industry from "static" recordings to "pseudo-live" compositions.

20) Playback can adapt to characteristics of the listener's playback system (for example, number of speakers, stereo or quad system, etc).

21) The playback device may include a variability control, which can be adjusted from no variability (i.e., the fixed default version) to the full variability defined by the artist in the composition definition.

22) The playback device can be located near the listener or remotely from the listener across a network or broadcast medium.

23) The variable composition can be protected from listener piracy by locating the playback device remotely from the user across a network, where listeners will only having access to a different version on each playback.

24) It is possible to optionally default to a fixed unchanging playback that is equivalent to the conventional static music playback.

25) Playback processing can be pipelined so that playback may begin before all the composition data has been downloaded or processed.

26) The artist may also control the amount of variability as a function of elapsed calendar time since composition release (or the number of times the composition has been played back). For example, no or little variability immediately following a composition's initial release, but increased variability after several months.

Although the above discussion is directed to the creation and playback of music, audio and sound by artists, it may also be easily applied to any other type of variable composition such as sound, audio, sound effects, musical instruments, variable demo modes for instruments, music videos, videos, multi-media creations, and variable MIDI-like compositions. Further objects and advantages of my invention will become apparent from a consideration of the drawings and ensuing description.

BRIEF DESCRIPTION OF DRAWINGS

FIG. 17 lists the disadvantages of pseudo-live music versus static music, and shows how each of these disadvantages can be overcome.

DETAILED DESCRIPTION

Figure 1:
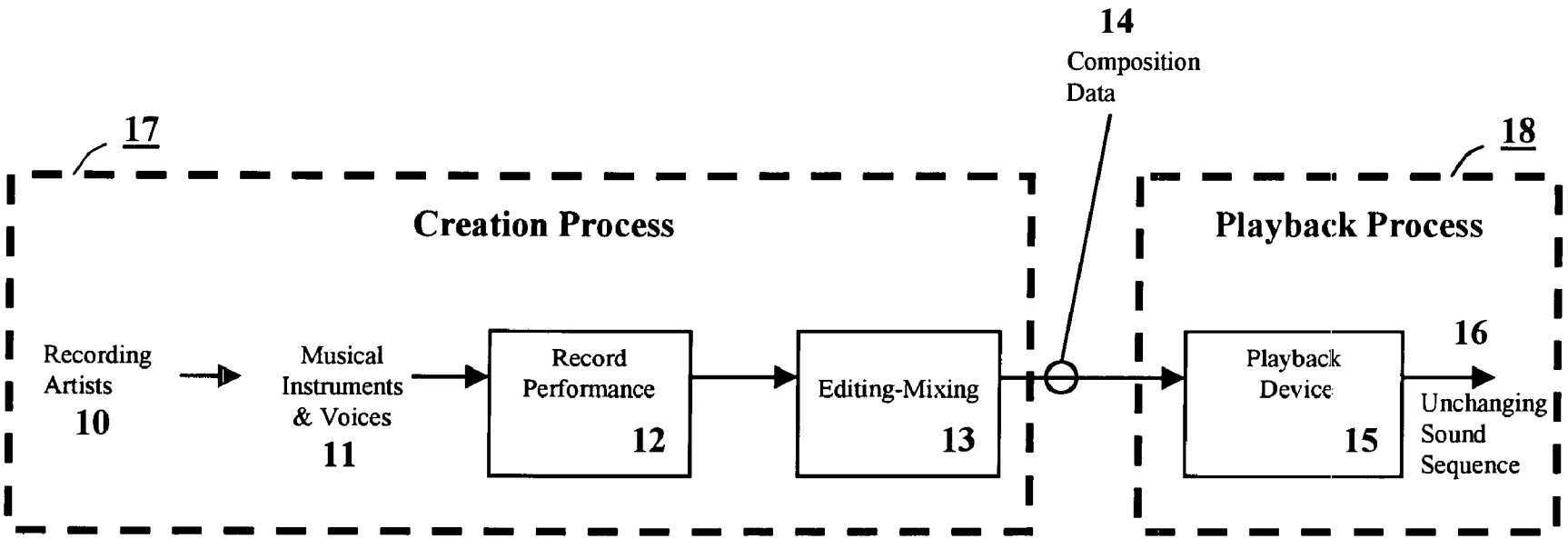
Figure 1. Prior Art
FIG. 1 is an overview of the composition creation and playback process for static music (prior-art).

Glossary of Terms:

The following definitions may be helpful:

Composition: An artist's definition of the sound sequence for a single song. A "static" composition generates the same sound sequence every playback. A pseudo-live (or variable) composition generates a different sound sequence, in a manner the artist defined, each time it is played back.

Channel: One of an audio system's output sound sequences. For example, for stereo there are two channels: stereo-right and stereo-left. Other examples include the four quadraphonic channels and digital 5.1 sound. In pseudo-live compositions, a channel is generated during playback by variably selecting and combining alternative sound segments.

Track: Storage (memory) holding a recorded sound segment. May be of a single instrument or voice. May be a combination/mix of many voices and/or instruments. During creation, many alternative sound segments are created and stored as tracks. Multiple tracks may also be mixed together and recorded as another track. The recorded segment may be digital sampled sound. In another embodiment, the recorded segment may be a MIDI-like command sequence that defines a sound segment.

Sound segment: A sequence of digitally sampled sound samples. A sound segment may represent a time slice of one instrument or voice or a time slice of many studio-mixed instruments and voices. During playback, many sound segments are combined together in alternative ways to form each channel. In another embodiment, a sound segment may also be defined by a sequence of MIDI-like commands that control one or more instruments that will generate the sound segment. During playback, each MIDI-like segment (command sequence) is converted to a digitally sampled sound segment before being combined with other segments. MIDI-like segments have the same initiation capabilities as other sound segments.

Group: A set of one or more sound segments (or snippets) for possible insertion at specific location(s) in a composition. Each group may include a segment selection method that defines how a segment or segments in the group are selected whenever the group is processed during playback. For some compositions, a given group may or may not be used in any given playback.

Initiation definition (spawn definition): An initiation definition identifies one group for initiation and a group insertion (initiation) time (or sample number) where that group is initiated. For some segments, one or more initiation definitions may be provided (associated) with each segment. Some segments may not have any initiation definitions provided (associated) with them.

Snippet: A sound segment. A snippet may also include one or more initiation definitions in-order to spawn other group (s) at defined location(s) in the same channel or in other channels. A snippet may also include edit variability parameters and placement variability parameters. For some compositions, only a fraction of all the snippets in a composition data set may be used in any given playback.

Spawn: To initiate the processing of a specific group and the insertion of one or more of it's processed sound segments at a specified location in a specified channel. Each snippet can spawn any number of groups that the artist defines. Spawning allows the artist to have complete control of the unfolding use of groups in the composition playback.

Artist(s): Includes the artists, musicians, producers, recording and editing personnel and others involved in the creation of a composition.

Studio or In-the-Studio: Done by the artists and/or the creation tools during the composition creation process.

Existing Recording Industry Overview:

FIG. 1 is an overview of the music creation and playback currently used by today's recording industry (prior art). With this approach, the listener hears the same music every time the composition is played back. A "composition" refers to a single song, for example "Yesterday" by the Beatles. The music generated is fixed and unchanging from playback to playback.

As shown in FIG. 1, there is a creation process 17, which is under the artist's control, and a playback process 18. The output of the creation process 17 is composition data 14 that represents a music composition (i.e., a song). The composition data 14 represents a fixed sequence of sound that will sound the same every time a composition is played back.

The creation process can be divided into two basic parts, record performance 12 and editing-mixing 13. During record performance 12, the artists 10 perform a music composition (i.e., song) using multiple musical instruments and voices 11. The sound from of each instrument and voice is, typically, separately recorded onto one or more tracks. Multiple takes and partial takes may be recorded. Additional overdub tracks are often recorded in synchronization with the prior recorded tracks. A large number of tracks (24 or more) are often recorded.

The editing-mixing 13 includes editing and then mixing of the recorded tracks in the "studio". The editing includes the enhancing individual tracks using special effects such as frequency equalization, track amplitude normalization, noise compensation, echo, delay, reverb, fade, phasing, gated reverb, delayed reverb, phased reverb or amplitude effects. In mixing, the edited tracks are equalized and blended together, in a series of mixing steps, to fewer and fewer tracks. Ultimately stereo channels representing the final mix (e.g., the master) are created. All steps in the creation process are under the ultimate control of the artists. The master is a fixed sequence of data stored in time sequence. Copies for distribution in various media are then created from the master. The copies may be optimized for each distribution media (tapes, CD, etc) using storage/distribution optimization techniques such as noise reduction or compression (e.g., analog tapes), error correction or data compression.

During the playback process 18, the playback device 15 accesses the composition data 14 in time sequence and the storage/distribution optimization techniques (e.g., noise reduction, noise compression, error correction or data compression) are removed/performed. The composition data 14 is transformed into the same unchanging sound sequence 16 each time the composition is played back.

Figure 2:
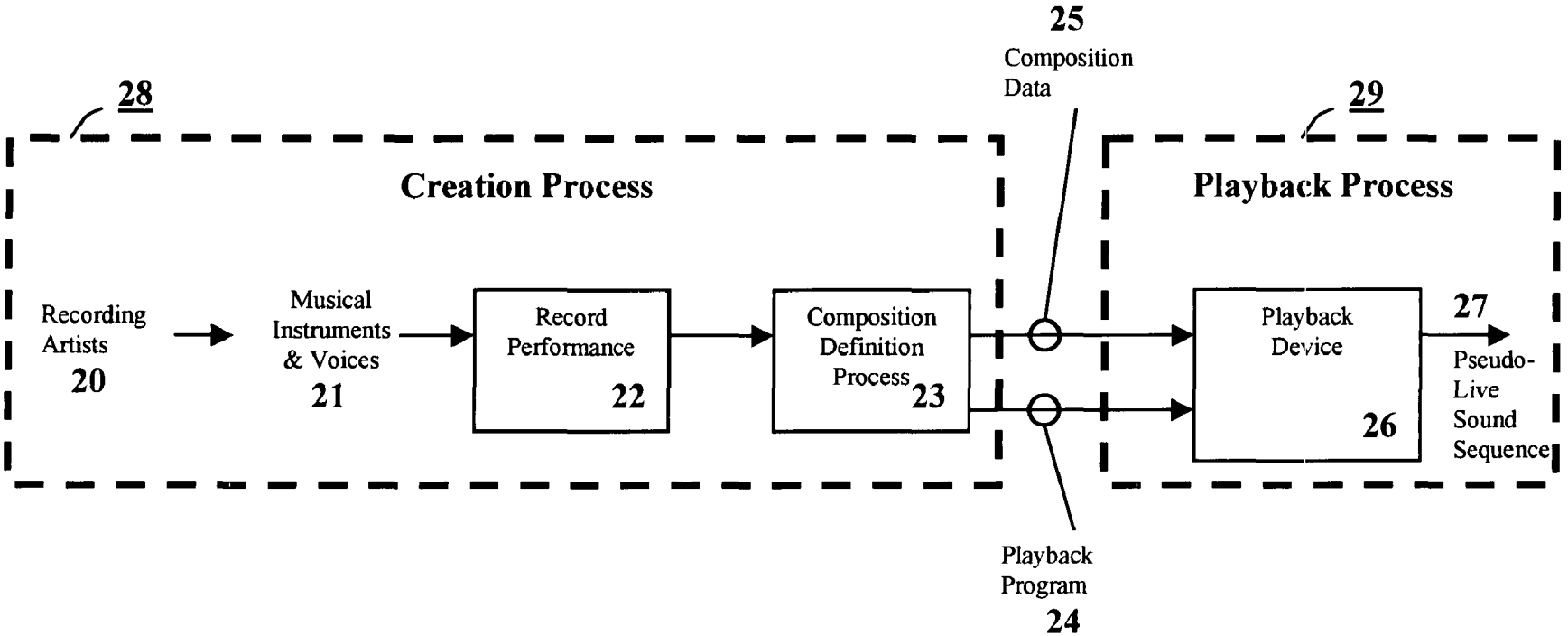
FIG. 2 is an overview of the composition creation and playback process for pseudo-live music and audio.

Overview of the Pseudo-Live Music & Audio Process (This Invention):

FIG. 2 is an overview of the creation and playback of Pseudo-Live music and sound (this invention). With this invention, the listener hears a different version each time a composition is played back. The music generated changes from playback-to-playback, by combining sound segments in a different way during each playback, in the manner the artist defined. This invention, allows the artist to have complete control over the playback variability that the listener experiences.

As shown in FIG. 2, there is a creation process 28 and a playback process 29. The output of the creation process 28 is a composition that is comprised of the composition data 25 and a corresponding playback program 24. The composition data 25 contains the artist's definition of a pseudo-live composition (i.e., a song). The artist's definition of the variable usage of sound segments from playback to playback is embedded in the composition data 25. Each time a playback occurs, the playback device 26 executes the playback program 24 to process the composition data 25 such that a different pseudo-live sound sequence 27 is generated. The artist maintains complete control of the playback via information contained within the composition data 25 that was defined in the creation process.

The composition data 25 is unique for each artist's composition. If desired the same playback program 24 may be used for many different compositions. At the start of the composition creation process, the artist may chose a specific playback program 24 to be used for a composition, based upon the desired variability techniques the artist wishes to employ in the composition. If desired, a playback program may be dedicated to a single composition. It is recognized, that if desired, the composition data could be distributed within and embedded within the playback program's code but some of the advantages of keeping the composition data and playback program separate may be lost.

The advantages of separating the playback program and the playback data, and allowing a playback program to be compatible with a plurality of compositions, include:

1) Allowing software tools, which aid the artist in the variable composition creation process, to be developed for a particular playback program. The development cost of these tools can then amortized over a large number of variable compositions.

2) Allowing simultaneous advancement in different areas of expertise. a) The creative use of a playback program by artists. b) The advancement of the playback programs by technologists. c) The advancement of the "variable composition" creation tools by technologists.

It is expected that the playback programs will advance over time with both improved versions and alternative programs, driven by artist requests for additional variability techniques. Over a period of time, it is expected that multiple playback programs will evolve, each with several different versions. Parameters that identify the specific version (i.e., needed capabilities) of the playback program 24 may be imbedded in the composition data 25. This allows playback program advancements to occur while maintaining backward compatibility with earlier pseudo-live compositions.

As shown in FIG. 2, the creation process 28 includes the record performance 22 and the composition definition process 23. The record performance 22 is very similar to that used by today's recording industry (shown in FIG. 1 and described in the previous section above). The main difference is that the record performance 22 for this invention (FIG. 2) will typically require that many more tracks and overdub tracks be recorded. These additional overdub tracks are ultimately utilized in the creation process as a source of variability during playback. In some cases, some alternative segments may be created and separately recorded, simultaneously with the creation of the segments that the alternatives will mix with during later playback. In some cases, some of the overdub (alternative) tracks may be created and recorded simultaneously with the artist listening to a playback of an earlier recorded track (or one of its component tracks). For example, the artists may create and record alternative overlay tracks, by voicing or playing instrument (s), while listening to a replay(s) of an earlier recorded track or sub-track.

The composition definition process 23 for this invention (FIG. 2) is more complex and has additional steps compared with the edit-mixing block 13 shown in FIG. 1. The output of the composition definition process 23 is composition data 25. During the composition definition process, the artist embeds the definition of the playback variability into the composition data 25.

Examples of Artistic Variations from Playback-to-Playback:

The types of variations the artist may employ to obtain creative playback-to-playback variability and which are supported by this invention, include:

1) Selecting between alternative versions/takes of an instrument and/or each of the instruments. For example, different drum sets, different pianos, different guitars.

2) Selecting between alternative versions of the same artist's voice or alternate artist's voices. For example, different lead, foreground or background voices.

3) Different harmonized combinations of voices. For example, "x" of "y" different voices or voice versions could be harmonized together.

4) Different combinations of instruments. For example, "x" of "y" percussion overlays (bongos, tambourine, steel drums, bells, rattles, etc).

5) Different progressions through the sections of a composition. For example, different starts, finishes and/or middle sections. Different ordering of composition sections. Different lengths of the composition payback.

6) Highlighting different instruments and/or voices at different times during a playback.

7) Variably inserting different instrument regressions. For example, sometimes a sax, trumpet, drum, etc solo is inserted at different times.

8) Varying the amplitudes of the voices and/or instruments relative to each other.

9) Variability in the placement of voices and/or instruments relative to each other from playback to playback.

10) Variations in the tempo of the composition at differing parts of a playback and/or from playback-to-playback.

11) Performing real-time special effects editing of sound segments before they are used during playback.

12) Varying the inter-channel relationships and inter-channel dependencies.

13) Performing real-time inter-channel special effects editing of sound segments before they are used during playback.

The types of playback variability may include all the variations that normally occur with live performances, as well as the creative and spontaneous variations artists employ during live performances, such as those that occur with jazz or jam sessions. The potential playback-to-playback variations are basically unlimited and are expected to increase over time as artists create new types.

An artist may not need to utilize all of the above variability methods for a particular composition. This invention can easily accommodate other methods of variability if artists desire them.

During the creation phase, the artist experiments with and chooses the editing and mixing variability to be generated during playback. Only those editing and mixing effects that are needed to generate playback variability are used in the playback process. It is expected that the majority of the special effects editing and much of the mixing will continue to be done in the studio during the creation process.

A very simple pseudo-live composition may utilize a fixed unchanging base track for each channel for the complete duration of the song, with additional instruments and voices variably selected and mixed onto this base. In another example, the duration of the composition may vary with each playback based upon the variable selection of different length segments, the variable spawning of different groups of segments or variable placement of segments. In even more complex pseudo-live compositions, many (or all) of the variability methods listed above are simultaneously used. In all cases, how a composition varies from playback to playback is determined by the artists definition created during the creation process.

Note that providing alternative sound segments that can be variably selected, may cause a significant increase in the amount of data contained in a composition data set. The variability created from this larger composition data set is intended to expand the listener's experience.

Composition Definition Process:

Prior to starting the composition definition process, the artists decide the various playback variability effects that may ultimately be incorporated into the variable composition. It is expected there will ultimately be various playback programs available to artists, with each program capable of utilizing a different set of playback variability techniques. It is expected that (interactive, visually driven) composition definition tools, optimized for the various playback programs, will assist the artist during the composition definition process. In this case, the artist chooses a playback program based on the variability effects they desire for their composition and the capabilities of the composition definition tools.

Figure 3:
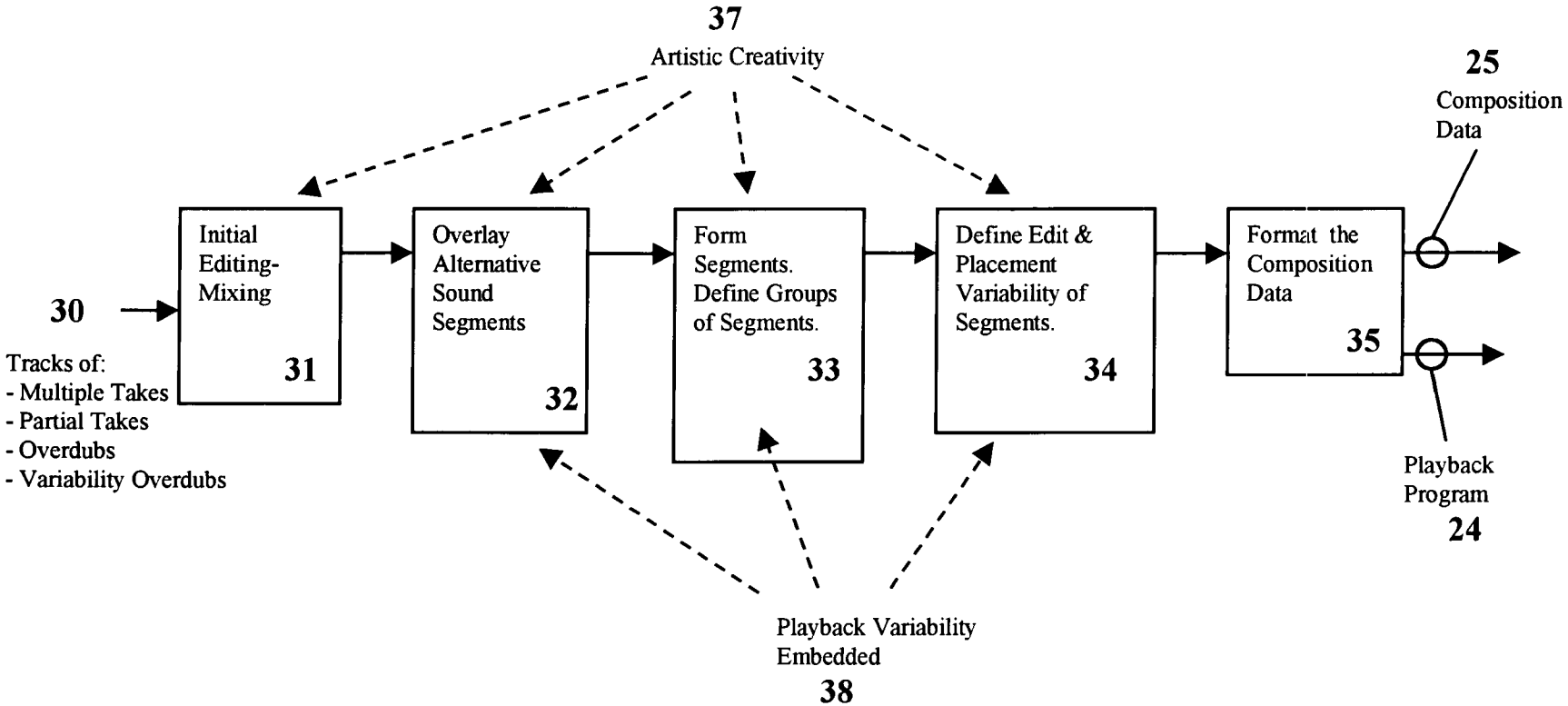
FIG. 3 is a flow diagram of the composition definition process (creation).

FIG. 3 is a flow diagram detailing the "composition definition process" 23 shown in FIG. 2. The inputs to this process are the tracks recorded in the "record performance" 22 of FIG. 2. The recorded tracks 30 include multiple takes, partial takes, overdubs and variability overdubs.

As shown in FIG. 3, the recorded tracks 30 undergo an initial editing-mixing 31. The initial mixing-editing 31 is similar to the editing-mixing 13 block in FIG. 1, except that in the FIG. 3 initial editing-mixing 31 only a partial mixing of the larger number of tracks is done since alternative segments are kept separate at this point. Another difference is that different variations of special effects editing may be used to create additional overdub tracks and additional alternative tracks that will be variably selected during playback. At the output of the initial editing-mixing 31, a large number of partially mixed tracks and variability overdub tracks are saved.

The next step 32 is to "overlay alternative sound segments" that are to be combined differently from playback-to-playback. In step 32, the partially mixed tracks and variability overdub tracks are overlaid and synchronized in time. Various alternative combinations of tracks (each track holding a sound segment) are experimented in various mixing combinations. When experimenting with alternative segments, the artists may listen to the mixed combinations that the listener would hear on playback, but the alternative segments are recorded and saved on separate tracks at this point. The artist creates and chooses the various alternate combinations of segments that are to be used during playback. Composition creation software may be used to automate the recording, synchronization and visual identification of alternative tracks, simultaneous with the recording and/or playback of other composition tracks. Additional details of this step are described in the "Overlaying Alternative Sound Segments" section.

The next step 33 is to "form segments and define groups of segments". The forming of segments and grouping of segments into groups depends on whether "pre-mixing" or "playback mixing" (described later) is used. If "pre-mixing" is used, additional slicing and mixing of segments occurs at this point. The synchronized tracks may be sliced into shorter sound segments. The sound segments may represent a studio mixed combination of several instruments and/or voices. In some cases, a sound segment may represent only a single instrument or voice.

A sound segment also may spawn (i.e., initiate the use of) any number of other groups at different locations in the same channel or in other channels. During a playback, when a group is initiated then one or more of the segments in the group is inserted based on the selection method specified by the artist. Based on the results of artist experimentation with various alternative segments, segments that are alternatives to be inserted at the same time location are defined as a group by the artist. The method to be used to select between the segments in each group during playback is also chosen by the artist. Additional details of this step are described in the "Defining Groups of Segments" and the "Examples of Forming Groups of Segments" sections.

The next step 34 is to define the "edit & placement variability" of sound segments. Placement variability includes a variability in the location (placement) of a segment relative to other segments. Based on artist experimentation, placement variability parameters specify how spawned snippets are placed in a varying way from their nominal location during playback processing. Edit variability includes any type of variable special effects processing that are to be performed on a segment during playback prior to their use. Based on artist experimentation, the optional special effects editing to be performed on each snippet during playback is chosen by the artist. Edit variability parameters are used to specify how special effects are to be varyingly applied to the snippet during playback processing. Examples of special effects that artists may define for use during playback include echo effects, reverb effects, amplitude effects, equalization effects, delay effects, pitch shifting, quiver variation, pitch shifting, chorusing, harmony via frequency shifting and arpeggio. Artist experimentation, also may lead to the definition of a group of alternative segments that are defined to be created from a single sound segment, by the use of edit variability (special effects processing) applied in real-time during playback. Variable inter-segment special effects processing, to be performed on multiple segments during playback, may also embedded into the composition at this point. Inter-segment effects allow a complementary effect to be applied to multiple related segments. For example, a special effect in one channel also causes a complementary effect in the other channel(s).

The final step 35 is to package the composition data, into the format that can be processed by the playback program 24. Throughout the composition definition process, the artists are experimenting and choosing the variability that will be used during playback. Note that artistic creativity 37 is embedded in steps 31 through 34. Playback variability 38 is embedded in steps 32 through 34 under artist control.

In-order to simplify the description above, the creation process was presented as a series of steps. Note that, it is not necessary to perform the steps separately in a sequence. There may be advantages to performing several of the steps simultaneously in an integrated manner using composition creation tools.

Figure 18:
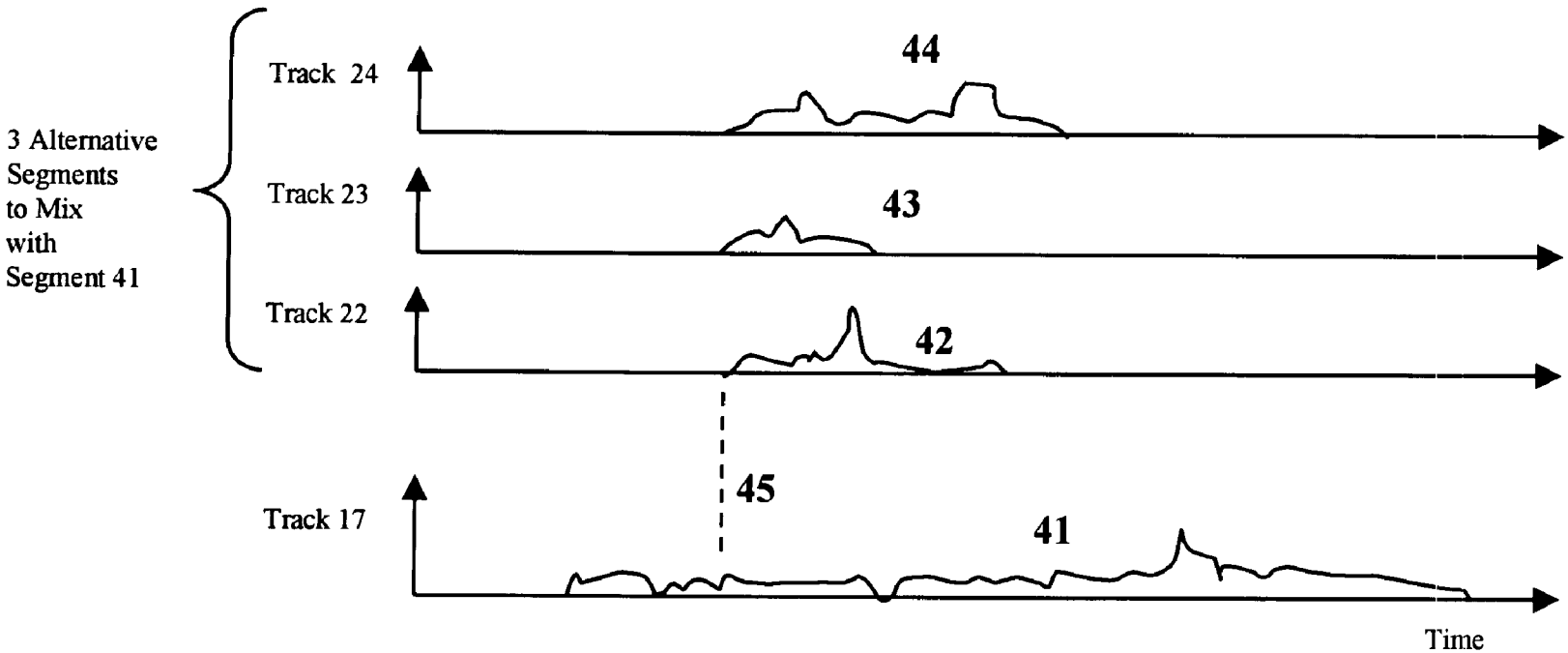
FIG. 18 shows an example of artists, in the studio, creating variability by adding different variations on top of a sound segment (creation).

Overlaying Alternative Sound Segments (Composition Creation Process):

FIG. 18 shows a simplified example of artists, in the studio, creating variability by adding different variations on top of a foundation (base) sound segment (track). In this example, segment 41 is a foundation segment, typically created in the studio by mixing together tracks of various instruments and voices. In this example, three variability segments (42, 43 and 44) are created by the artists. Each of the variability segments my represent an additional instrument, voice or a mix of instruments and/or voices that is to be separately mixed with segment 41. The variability segments may be created and recorded by the artists simultaneous with the creation or re-play of the foundation segment or with the creation or re-play of sub-tracks that make up the foundation segment. Alternatively, some of the variability segments may be created by using in-studio special effects editing of a recorded segment or segments in-order to create alternatives for playback. The artists define the time or sample location 45 where alternate segments are to be located relative to segment 41. Note that null value samples may be appended to the beginning or at the end of any of the alternate segments, if needed for alignment reasons.

Figure 20:
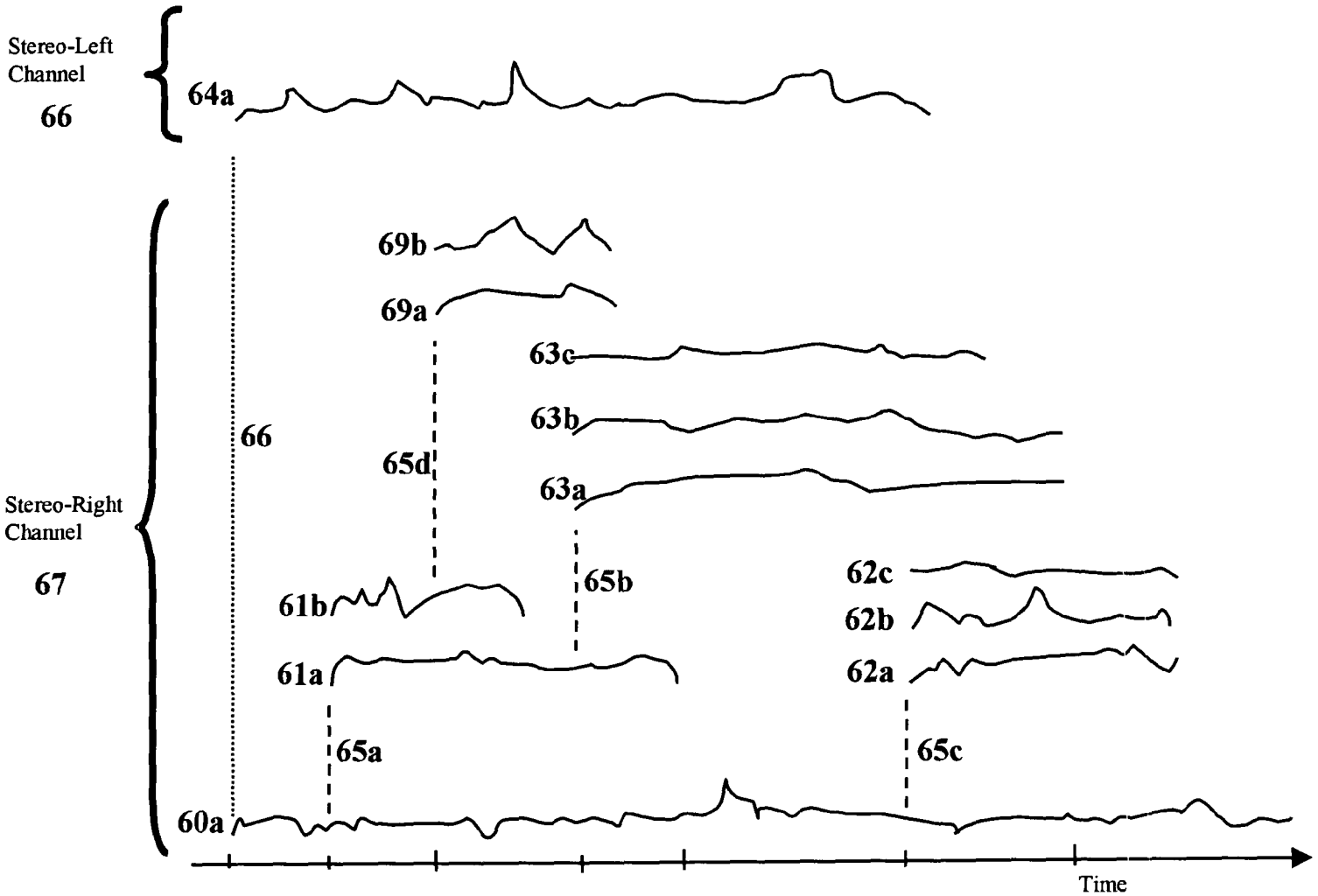
FIG. 20 shows a more complicated example of artists, in the studio, creating and recording multiple groups of alternative segments that overlap in time (creation).

FIG. 20 shows a more complex example of artists, in the studio, creating and recording multiple groups of alternative segments that overlap in time. This example is intended to illustrate capabilities rather than be representative of an actual composition. In-order to simplify this example, the number of alternative segments in each group are limited to only two or three. Segment 60*a*, a segment in the stereo right channel 67, is overlaid with a choice of alternative segments 61*a* or 61*b* at insertion location 65*a* and also overlaid with a choice of alternative segments 62*a*, 62*b* or 62*c* at insertion location 65*c*. If segment 61*a* is selected for use then one of alternative segments 63*a*, 63*b* or 63*c* is also to be used. If segment 61*b* is selected for use then one of alternative segments 69*a* or 69*b* is also to be used. Similarly (but not shown in FIG. 20), the artists may form the stereo left channel (and other desired channels) by locating the stereo left segments relative to segment 60*a* or any other segments.

Defining Groups of Segments (Composition Creation Process):

There are two general strategies for partitioning overlapping alternative segments into groups in-order to generate variability during later playback:

1) "Pre-mixing" of the alternative combinations in the studio. The alternative combinations of sound segments are mixed in advance in the studio. During playback, the pre-mixed segments are variably selected and combined without using playback mixing.

2) Real-time "playback mixing". During playback, alternative overlapping sound segments are variably selected and the overlapping segments are mixing together.

If desired, a combination of both methods maybe used in the same variable composition. For both methods, it is recommended that, the segments be synchronized and located accurately in time in-order to meet the quality standards expected of the recording industry compositions.

Note that, "playback mixing" partially repartitions the editing-mixing functions that are done in the studio by today's recording industry (prior art). The artists decide which editing and mixing functions are to be done during playback, to vary the music from playback to playback. The editing-mixing that is not needed to generate playback variability, is expected to continue to be done in the studio.

Examples of Forming Groups of Segments (Composition Creation Process):

The following paragraphs show additional details of the "forming segments and defining groups of segments" (shown in block 33 of FIG. 3).

Figure 4:
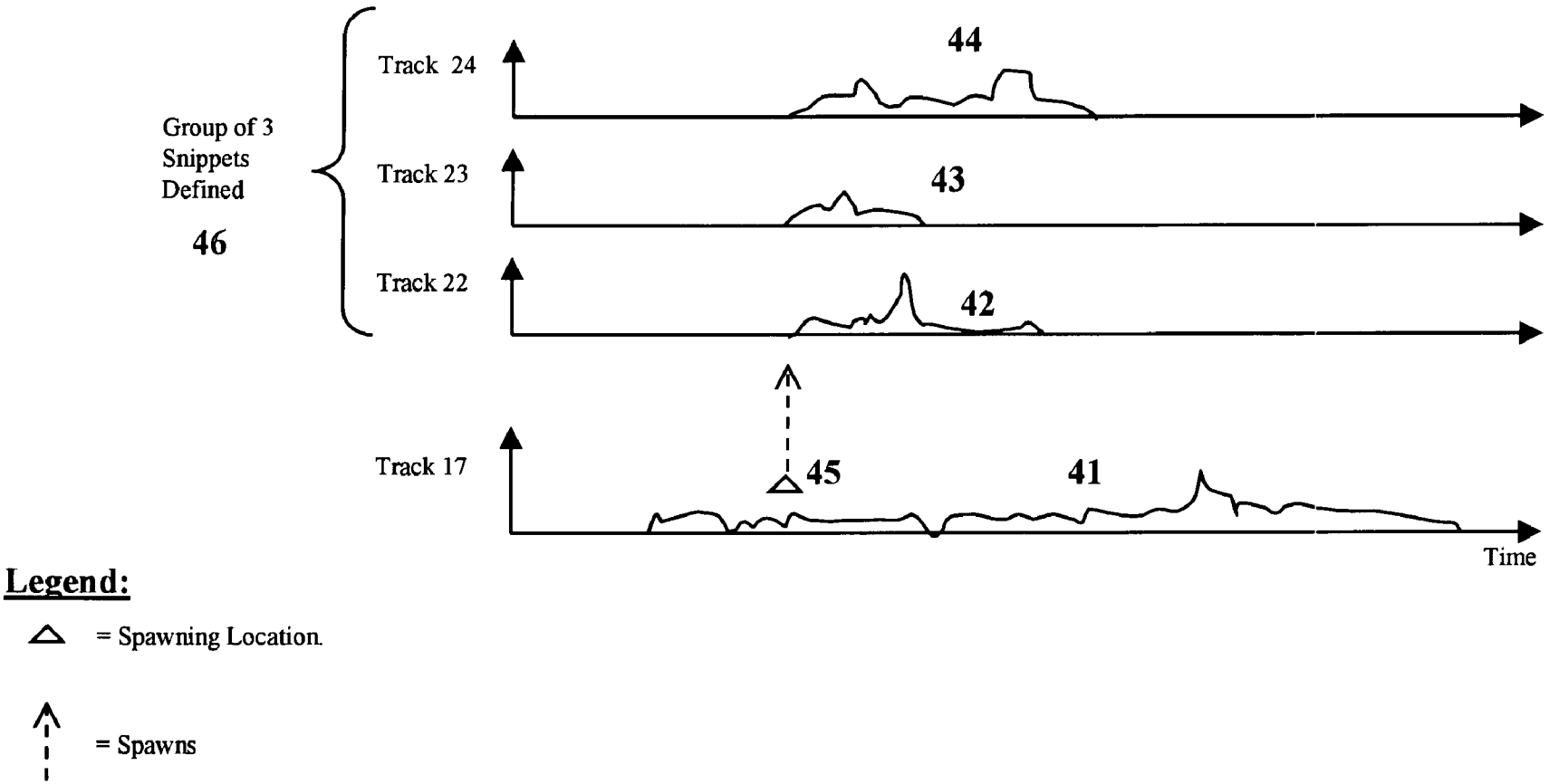
FIG. 4 is an example of defining a group of sound segments (in an initiation timeline) during the composition definition process to allow real-time "playback mixing" (creation).

FIG. 4 is a simplified example of defining a group of sound segments (in an initiation timeline) to allow real-time "playback mixing". The starting data is shown in FIG. 18 and was discussed earlier. Four tracks containing sound segments are shown in FIG. 4. One of segments 42,43, 44 is to selected and mixed with segment 41 during a playback. The artist defines a group containing three segments (42, 43, 44). The artist also defines the selection method to be used to chose among the three segments during playback, in this case, an equally likely random choice of one of the three segments in the group. The artist defines the insertion time 45 (or sample number) where the group will be initiated at during later playback. If desired, the artist may also define special effects processing to be performed on the segments prior to mixing. If desired, the artist may also define a playback-to-playback variability from the nominal in placing the segments.

Figure 21:
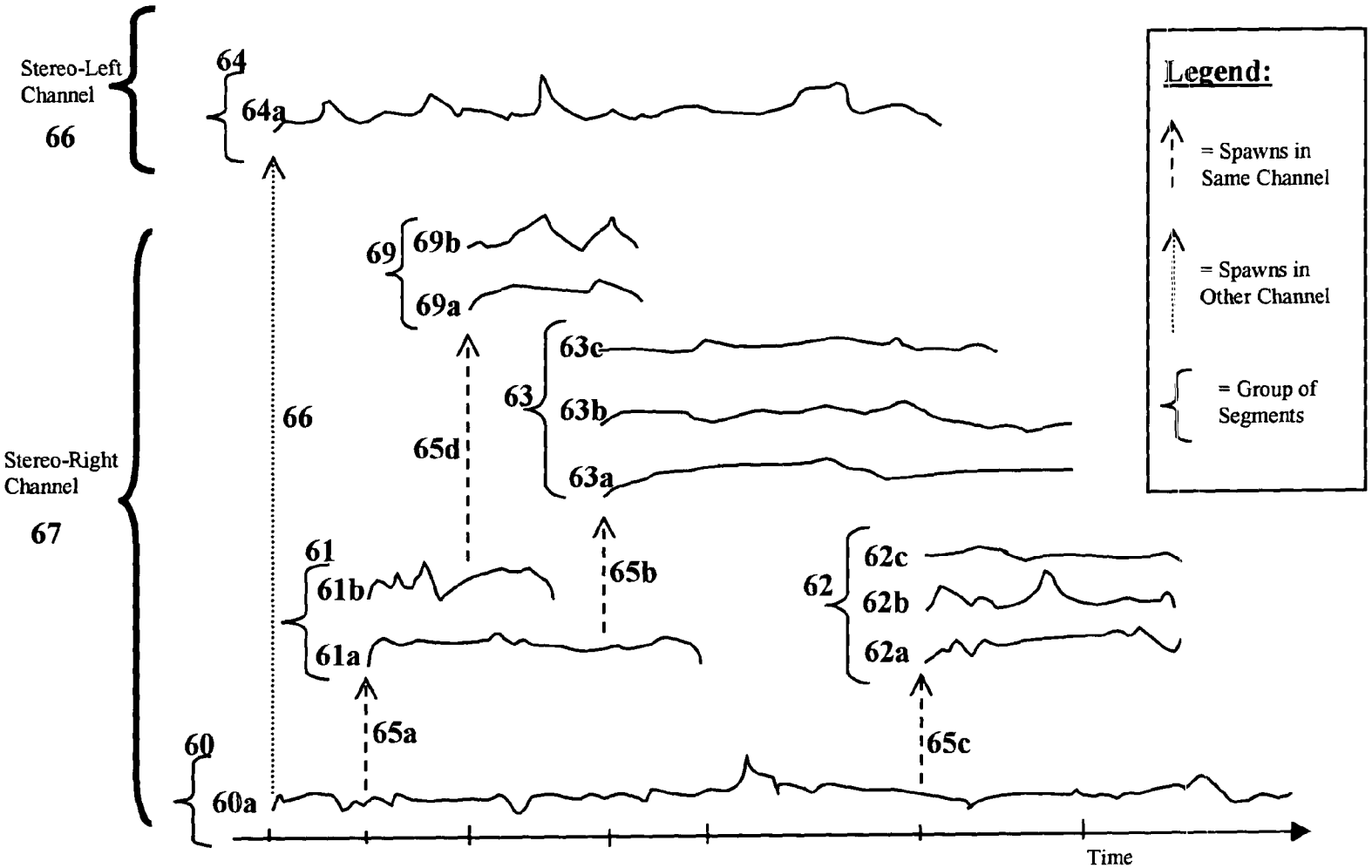
FIG. 21 is a more complicated initiation timeline that illustrates real-time "playback mixing" (creation).

FIG. 21 is a more complicated initiation timeline that illustrates real-time "playback mixing". FIG. 21 is a more complicated example of defining groups to allow real-time "playback mixing". The starting data is shown in FIG. 20 and was discussed earlier. The artist defines group 61 containing segments 61*a* and 61*b*. The artist defines a selection method for group 61 and the group 61 insertion time 65*a* relative to segment 60*a* where the group will be initiated at during later playback. The artist defines group 62 containing segments 62*a*, 62*b* and 62*c*. The artist defines a selection method for group 62 and the group 62 insertion time 65*c* relative to segment 60*a* where the group will be initiated at during later playback. The artist defines group 63 containing segments 63*a*, 63*b* and 63*c*. The artist defines a selection method for group 63 and the group 63 insertion time 65*b* relative to segment 61*a* where the group will be initiated at during later playback. The artist defines group 69 containing segments 69*a* and 69*b*. The artist defines a selection method for group 69 and the group 69 insertion time 65*d* relative to segment 61*b* where the group will be initiated at during later playback. The artist defines group 64 to contain segment 64*a*. The artist defines a selection method for group 64 and the group 64 insertion time (into the stereo-left channel) relative to segment 60*a* where the group will be initiated at during later playback. If desired, the artist may also define special effects processing to be performed on the segments prior to mixing. If desired, the artist may also define a variability from the nominal in placing the segments. An equally likely random choice of one of the segments in a group is used in this example.

Figure 19:
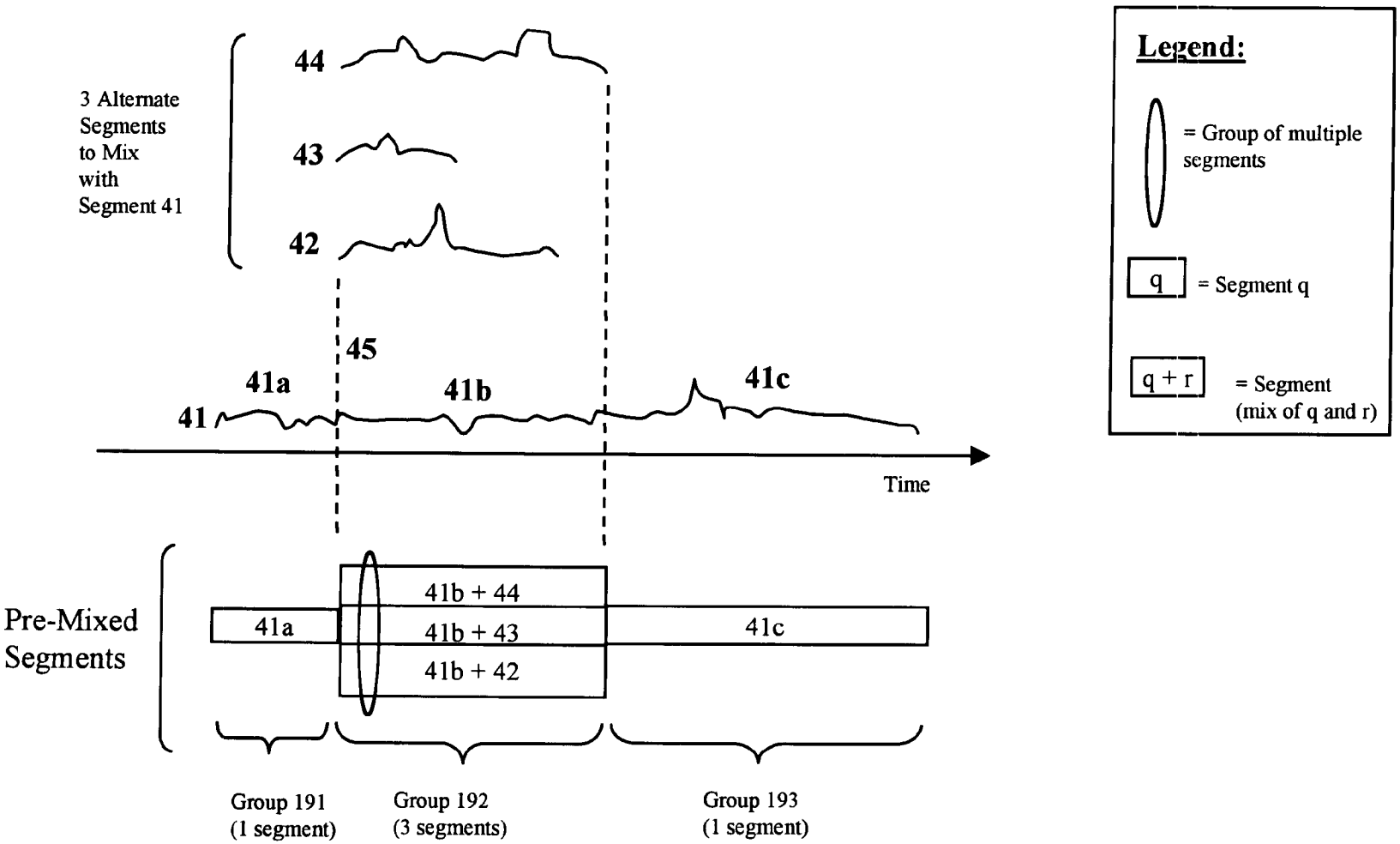
FIG. 19 is a simplified initiation timeline that illustrates an in-the-studio "pre-mix" of the alternative combinations of overlapping segments (creation).

FIG. 19 is a simplified initiation timeline that illustrates an in-the-studio "pre-mix" of the alternative combinations of overlapping segments (creation). FIG. 19 is a simplified example of defining groups of "pre-mixed" segments. The starting data is shown in FIG. 18 and repeated at the top of FIG. 19. In this case, segment 41*b* is mixed with segment 42 and the resulting segment (41*b*+42) in the overlapping area, is saved. Segment 41*b* is mixed with segment 43 and the resulting segment (41*b*+43) in the overlapping area, is saved. Segment 41*b* is mixed with segment 44 and the resulting segment (41*b*+44) in the overlapping area, is saved. Group 192 comprising three segments (41*b*+42), (41*b*+43) and (41*b*+44) in the overlap area) is defined. The artist also defines the selection method to be used to chose among the three segments during playback, in this case, an equally likely random choice of one of the three segments in the group. Group 191 comprising one segment (41*a*) is defined. Group 193 comprising one segment 41*c* is defined. Segments 41*a* is defined to have one initiation definition, which initiates group 192 at the sample immediately following the end of the segment 41*a*. Segments (41*b*+42), (41*b*+43) and (41*b*+44) are each defined to have one initiation definition, which initiates group 193 at the sample immediately following the end of each the segments.

Figure 22:
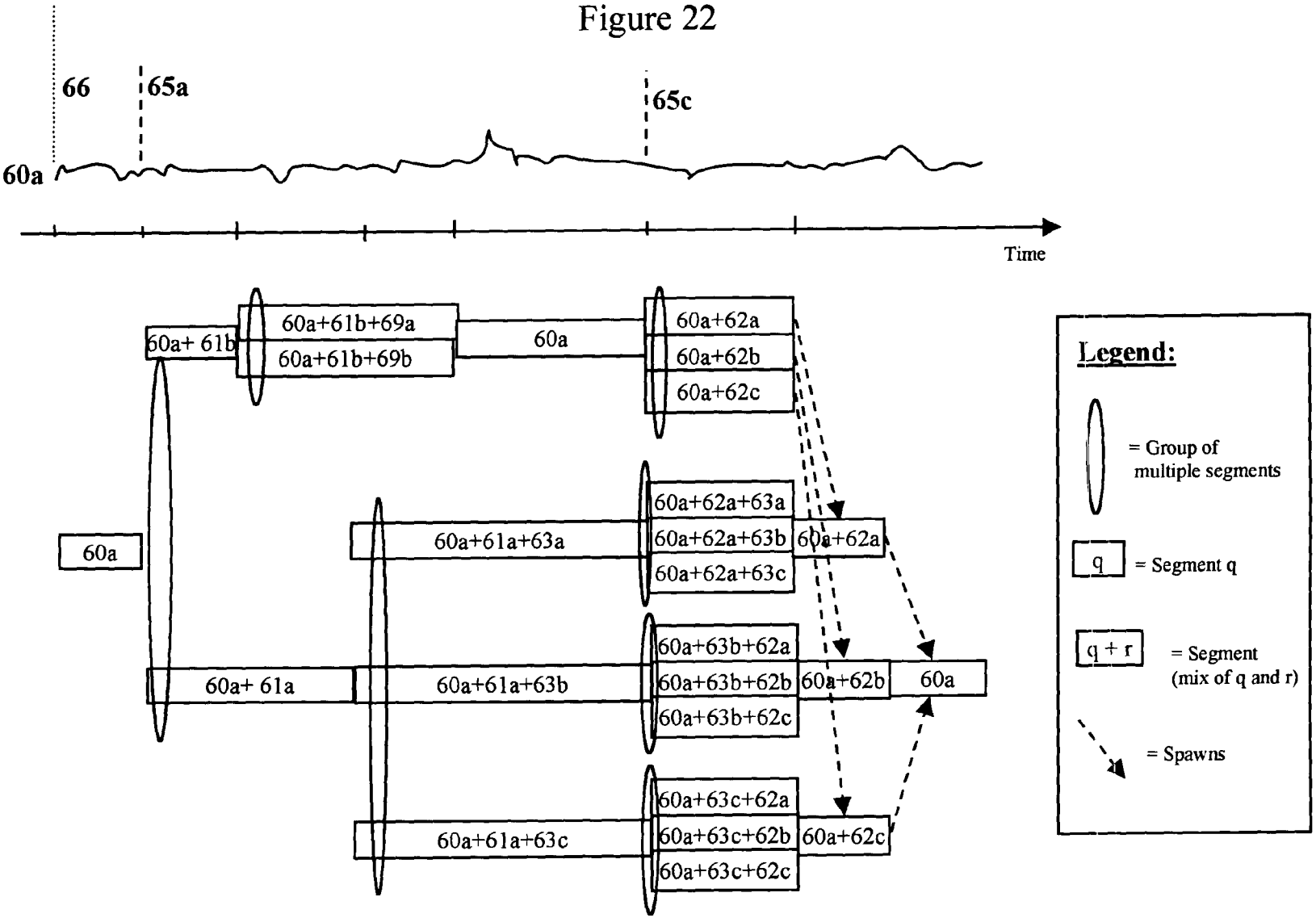
FIG. 22 is a more complicated initiation timeline that illustrates an in-the-studio "pre-mix" of alternative combinations of overlapping segments (creation).

FIG. 22 is a more complicated initiation timeline that illustrates an in-the-studio "pre-mix" of alternative combinations of overlapping segments (creation). FIG. 22 is a more complicated example of defining groups in-order to "pre-mix" the alternative combinations of overlapping segments in the studio. The starting data is shown in FIG. 20 and is partially repeated at the top of FIG. 22 in-order to provide a time reference to the detail on FIG. 20. To simplify the illustration, only the stereo-right channel is illustrated and it is assumed that group 60 contains only segment 60*a*. Note that each segment spawns a "following" group at the sample immediately following the segment. Segments 60*a* also spawns group 64 at the first sample of the segment 60*a*. Initially, only segment 60*a* is used since there is no segment overlap initially in the stereo-right channel. A group comprised of segments (60*a*+61*a*) and (60*a*+61*b*) is defined. Where (60*a*+61*a*) indicates a mix of segment 60*a* and segment 61*a*, for the sliced up time intervals time shown.

Following the upper path when segment 61*b* is assumed to be selected, segment (60*a*+61*b*) then spawns a group comprised of segments (60*a*+61*b*+69*a*) and (60*a*+61*b*+69*b*). Segments (60*a*+61*b*+69*a*) and (60*a*+61*b*+69*b*) are each defined to spawn a group comprised of segment 60*a*. Segment 60*a* is defined to spawn a group comprised of segments (60*a*+62*a*), (60*a*+62*b*) and (60*a*+62*c*). Segment (60*a*+62*a*) is defined to spawn a group comprised of segment (60*a*+62*a*). Segment (60*a*+62*b*) is defined to spawn a group comprised of segment (60*a*+62*b*). Segment (60*a*+62*c*) is defined to spawn a group comprised of segment (60*a*+62*c*). Finally, segments (60*a*+62*a*), (60*a*+62*b*) and (60*a*+62*c*) are each defined to spawn a group comprised of segment 60*a*.

Following the lower path when segment 61*a* is assumed to be selected, segment (60*a*+61*a*) then spawns a group comprised of segments (60*a*+61*a*+63*a*), (60*a*+61*a*+63*b*) and (60*a*+61*a*+63*c*). Segment (60*a*+61*a*+63*a*) then spawns a group comprised of segments (60*a*+62*a*+63*a*), (60*a*+62*a*+63*b*) and (60*a*+62*a*+63*c*). Each of the segments (60*a*+62*a*+63*a*), (60*a*+62*a*+63*b*) and (60*a*+62*a*+63*c*) then spawns a group comprised of segment (60*a*+62*a*). Segment (60*a*+62*a*) then spawns a group comprised of segment 60*a*. The spawning continues in a similar manner for the rest of the lower path shown in FIG. 22.

Notice that the number of pre-mixed segments increases with the number of overlapping alternate segments. If groups 62 and 63 had each had 7 alternative segments (instead of 3), an additional 40 (=7×7−3×3) pre-mixed segments would have been created.

The advantages of real-time "playback mixing" (relative to "pre-mixing") include:

1) A significantly smaller composition data size for compositions with many overlapping groups of alternatives. Consider a composition with 4 different simultaneously overlapping groups of segments with 5 segments in each group. With "playback mixing", the composition data would contain the 20 (=4×5) segments in the overlap region. With "pre-mixing", the composition data would contain 625 (=5×5×5×5) segments representing all the possible combinations of the segments. With "pre-mixing" the amount of composition data expands exponentially with the number of simultaneously overlapping groups and the number of segments in each group.

2) Ability to create additional variability by performing special effects processing (to alter one or more segments) during playback but prior to playback mixing of the segments.

The disadvantages of real-time "playback mixing" include a significant increase in playback processing and the difficulties of performing the mixing in real-time during playback.

The advantages of "pre-mixing" (relative to "playback mixing") include:

1) Simpler and reduced playback processing. Requires less playback processor capability. Easier to pipeline (stream).

2) Easier to assure quality since all mixing is done in the studio. Playback is just variably selecting and combining segments in time.

3) Reasonable when there are a small number of simultaneously overlapping groups and the number of segments in each group is small.

Note that due to its generality, this invention supports both of these playback strategies as well as a composition that simultaneously uses both strategies.

Playback Combining and Mixing Considerations:

For some applications, it is desirable that the music quality after playback combining and mixing should be comparable or better to that of "static" compositions by today's recording industry. The sound segments provided in the composition data set and used for playback combining and mixing should be frequency equalized and appropriately pre-scaled relative to each other in the studio. In addition, where special effects processing is performed on a segment during playback before it is used, additional equalization and scaling may be performed on each segment to set an appropriate level before it is combined or mixed during playback. To prevent loss of quality due to clipping or compression, the digital mixing bus should have sufficient extra bits of range to prevent digital overflow during digital mixing. To preserve quality, dithering (adding in random noise at the at the appropriate bit level) may used during "playback mixing", in a manner similar to today's in-studio mixing. Normalization and/or scaling may also be utilized following combining and/or mixing during playback. Accurate placement of segments relative to each other during payback processing is critical to the quality of the playback.

Figure 5:
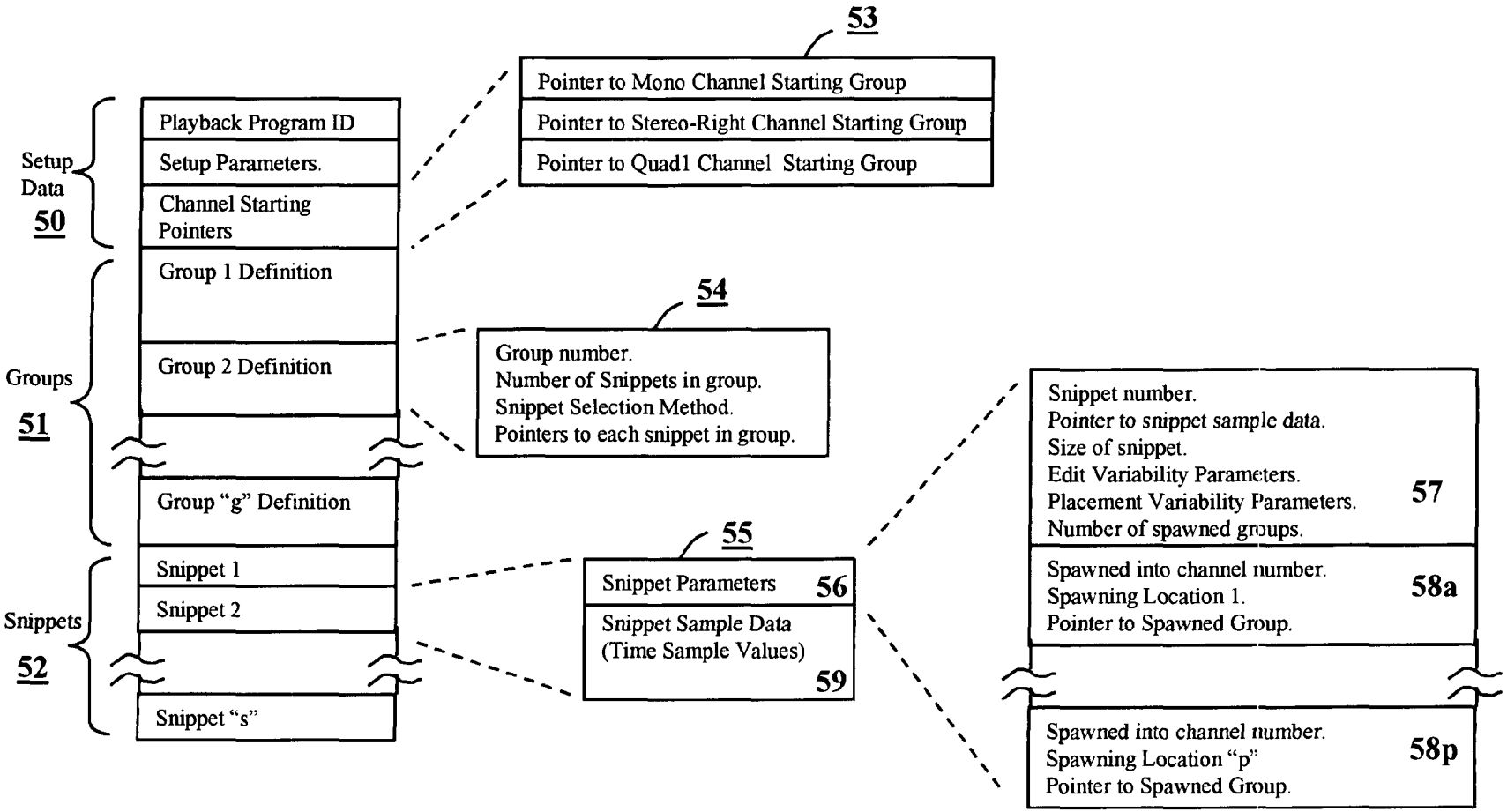
FIG. 5 details a format of the composition data.

Format of Composition Data:

FIG. 5 shows details of a format of the composition data 25. Although a detailed format is presented, it should be realized that there are many alternate sets of parameters and arrangements of parameters that accomplish a similar result and fall within the inventive concepts disclosed herein. The composition data 25 will have a specific format, which is recognized by a specific playback program 24. The amount of data in the composition data format will differ for each composition but it is a known fixed amount of data that is defined by the composition creation process 28.

The composition data are a fixed, unchanging, set of digital data (e.g., bits or bytes) that are a digital representation of the artist's composition. The composition data can be stored and distributed on any conventional digital storage mechanism (such as disks, tape or memory) as well as broadcast through the airwaves or transmitted across networks (such as the Internet).

If desired the composition data 25 can be stored in a compressed form by the use of a data compression program. Such compressed data would need to be decompressed prior to being used by the playback program 24.

In-order to allow great flexibility in composition definition, pointers are used throughout the format structure. A pointer holds the address or location of where the beginning of the data pointed to will be found. Pointers allow specific data to be easily found within packed data elements that have arbitrary lengths. For example, a pointer to a group holds the address or location of where the beginning of a group definition will be found.

As shown in FIG. 5, the composition data 25 includes three types of data:

1.) Setup data 50

2.) Groups 51

3.) Snippets 52.

The setup data 50 includes data used to initialize and start playback and playback setup parameters. The setup data 50 includes a playback program ID, setup parameters, channel starting pointers.

The playback program ID indicates the specific playback program and version to be used during playback to process the composition data. This allows the industry to utilize and advance playback programs while maintaining backward compatibility with earlier pseudo-live compositions.

The setup parameters include all those parameters that are used throughout the playback process. The setup parameters include a definition of the channel types that can be created by the composition (for example, mono, stereo, quad, etc). Other examples of setup parameters include "max placement variability" and playback pipelining setup parameters (which are discussed later).

The channel starting pointers (shown in block 53) point to the starting group to be used for the starting channel for mono, stereo and quad channel types. Each playback device indicates, the specific channel types it desires. The playback program begins processing the starting group corresponding to the channel types requested by the playback device. For example, for a stereo playback device, the program begins with the stereo-right channel, starting group. The stereo left channel, starting group is spawned from the stereo right channel, so that the channels may have the artist desired channel dependency. Note that for the stereo channel example, the playback program only generates the two stereo channels desired by the playback device (and the mono and quad channels would not be generated). During playback, the unfolding of events in one channel is usually not arbitrary or independent from other channels. Often what is happening in one channel may need to be dependent on what occurs in another channel. Spawning groups into other channels allows cross channel dependency and allows variable complementary channel effects.

The groups 51 includes "g" group definitions. Any number of groups may be used and the number used will be unique for each artist's composition. The size of each group definition may be different. If the artist desires, a group can be used multiple times in a chain of spawned snippets. A group may be used in as many different chains of spawned snippets as the artist desires.

Referring to FIG. 5, block 54 details the contents of each group definition. The group definition parameters and their purposes are:

1.) "Group number" is a group ID.

2.) Number of snippets in the group. Used to identify the end of the snippet pointers.

3.) Snippet selection method. The snippet selection method defines how one or more of the snippets in the group is to be selected each time the group is used during playback.

The selection method to be used for each group may be defined by the artist. The artist may define that one of the snippets in a group is selected with equal probability (or other probability distribution). Note that artists may define many other methods of selecting segments besides just a random selection of one of the segments in a group. For example, if the artist desires a variable harmony of voices (or a variable combination of instruments) then a choice of "y" of the "z" segments in the group could be used. For example, a random choice of "3" of the "8" segments in the group may be used. Or perhaps a variable, random choice of "1, 2 or 3" of the 8 segments in the group may be used.

4.) Pointers to each snippet in the group. Allows the start of each snippet to be found.

The snippets 52 includes "s" snippets. Any number of snippets may be used and the number used will be unique for each artist's composition. A snippet definition may be any length and each snippet definition will typically have a different length. If the artist desires, the same snippet can be used in different groups of snippets. The total number of snippets (s) needed for a single composition, of several minutes duration, may be quite large (100's to 100,000's or more) depending on the artist's definition (and whether optional pipelining, as described later, is used).

Block 55 details the contents of each snippet. Each snippet includes snippet parameters 56 and snippet sample data 59. The snippet sample data 59 is a sequence of time sample values representing a portion of a track, which is to be combined to form an output channel during playback. Typically, the time samples represent amplitude values at a uniform sampling rate. Note that an artist can optionally define a snippet with time sample values of all zeroes (null), yet the snippet can still spawn groups.

Referring to FIG. 5, the snippet parameters 56 include snippet definition parameters 57 and "p" spawned group definitions (58*a* and 58*p*).

The snippet definition parameters 57 and their purpose are as follows:

1.) The "snippet number" is a snippet ID.

2.) The "pointer to the start of data" allows the start of "snippet sample data" to be found.

3.) The "size of snippet" is used to identify the end of the snippet's sample data.

4.) The "edit variability parameters" may be used to specify special effects editing to be done during playback. Edit variability parameters are used to specify how special effects are to be varyingly applied to the snippet during playback processing. Use of edit variability is optional for any particular artist's composition. Examples of special effects that may be applied to segments during playback processing include echo effects, reverb effects, amplitude effects, equalization effects, delay effects, pitch shifting, quiver variation, pitch shifting, chorusing, harmony via frequency shifting and arpeggio. Note that, many of the edit variability effects can be alternately accomplished by an artist by using more snippets in each group (where the edit variability processing was done during the creation process and stored as additional snippets to be selected from a group).

5.) The "placement variability parameters" may be used to specify how spawned snippets are placed in a varying way from nominal during playback processing. Placement variability also allows the option of using or not using a snippet in a variable way. Use of placement variability is optional for any particular artist's composition. Note that, many of the placement variability effects can be alternately accomplished by using more snippets in each group (where the placement variability processing was done during the creation process and stored as additional snippets to be selected from a group).

6.) The number of spawned groups is used to identify the end of the "p" spawned group definitions.

Each "spawned group definition" (58*a* and 58*p*) identifies the spawn of a group from the current snippet. "Spawn" means to initiate the processing of a specific group and the insertion of one of it's processed snippets at a specified location in a specified channel. Each snippet may spawn any number of spawned groups and the number spawned can be unique for each snippet in the artist's composition.

Note that spawning allows the artist to have complete control of the unfolding use of groups in the composition playback. For many recording-industry type musical compositions, it is expected that, the selection of groups to use will not be randomly or statistically determined, because this may result in excessive variability and incomplete artistic control over the composition playback. If desired by the artists for some applications, a random or statistical selection of groups to be used can be easily incorporated into this invention.

Because of the use of pointers, there is no limit to the artist's spawning of snippets from other snippets. The parameters of the "spawned group definition" (58*a* and 58*p*) and their purpose are as follows:

1.) The "spawned into channel number" identifies which channel the group will be placed into. This parameter allows snippets in one channel to spawn snippets in any other channel. This allows the artist to control how an effect in one channel will result in a complementary effect in another channel.

2.) The "spawning location" identifies the time location where a spawned snippet is to be nominally placed.

3.) The "pointer to spawned group" identifies which group of snippets the spawned snippet will come from.

Figure 6:
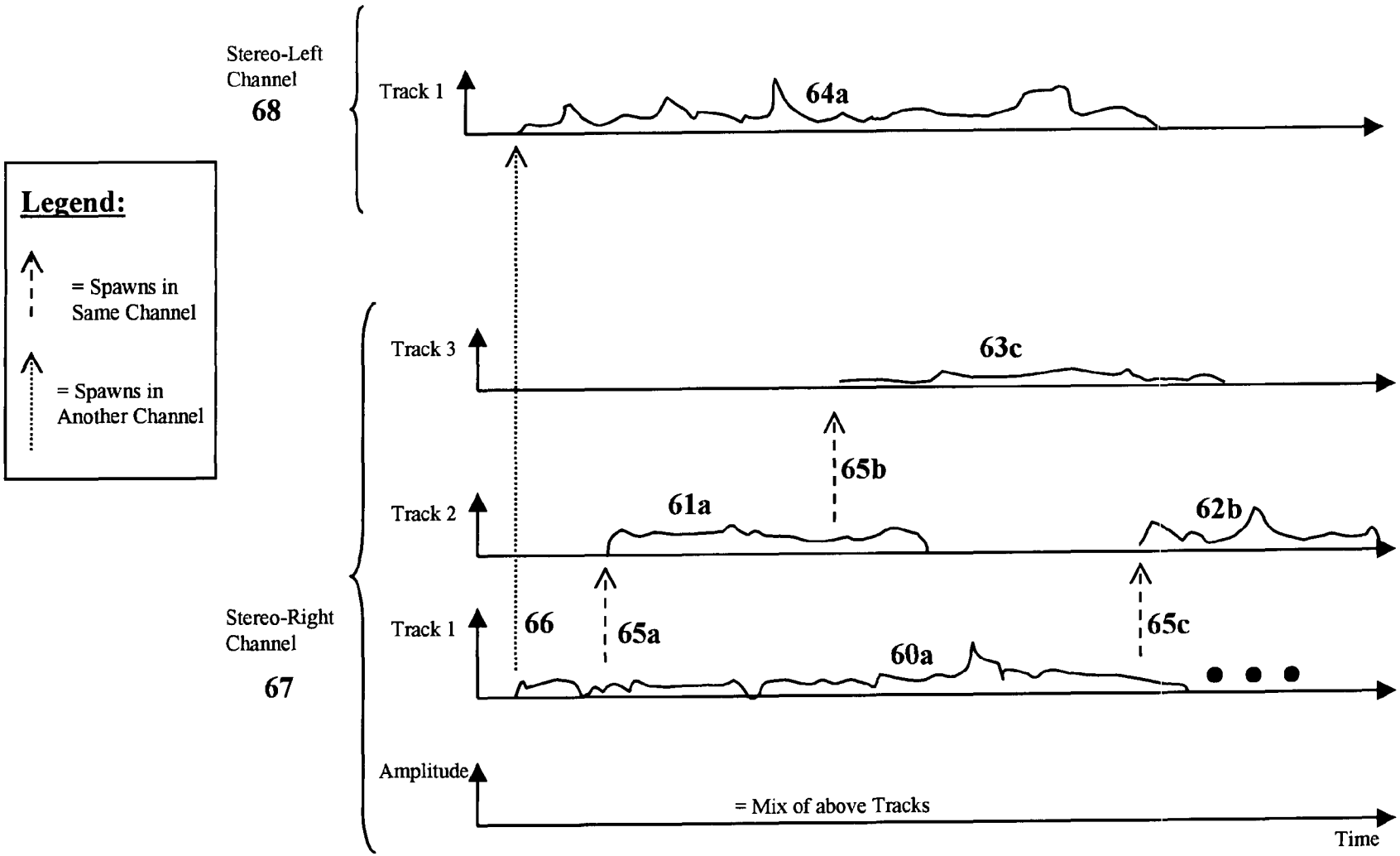
FIG. 6 is an example of the placing and mixing of sound segments during playback processing (playback).

Example of Placing & Mixing Snippets (Playback Processing):

FIG. 6 is an example of the placing and mixing of snippets during playback processing to generate stereo channels. This example is representative of the real-time "playback mixing" of the composition data shown in FIG. 21. This example is intended to illustrate the flexibility available in the spawning of groups and the placement of snippets. It is not intended to be representative of an actual composition. The steps in FIG. 8, blocks 80 through 82 are performed before placing a snippet during playback:

1.) The snippet was selected from a group of snippets (80).

2.) The snippet was edited for special effects (81).

3.) The snippet placement variability from nominal was determined (82).

Note that each of these 3 steps is a source of additional variability that the artist may have chosen to utilize for a given composition. In order to simplify the example, snippet placement variability is not used in FIG. 6.

As shown in FIG. 6, the first snippet 60*a* to be placed, was selected from the "stereo-right channel starting group" defined in the composition data.

Snippet 60*a* then spawns two groups in the same channel (stereo-right) at spawning locations 65*a* and 65*c*. Snippet 61 assumed to have been randomly selected from group 61, during this playback, is placed into track 2 on the stereo-right channel at spawning location 65*a*. Similarly, snippet 62*b* assumed to have been randomly selected from group 62, during this playback, is placed into track 2 on the stereo-right channel at spawning location 65*c*. Track 2 can be used for both snippets since they don't overlap. If these snippets overlapped, then snippet 62*b* would be placed into another track. Snippet 61*a* then spawns group 63 in the stereo-right channel at spawning location 65*b*. Snippet 63*c*, assumed to have been randomly selected from group 63, during this playback, is placed in track 3 of the stereo-right channel at spawning location 65*b*.

Snippet 60*a* also spawned group 64 in the stereo-left channel at spawning location 66. Snippet 64*a* is selected from group 64 and is placed into track 1 on the stereo-left channel at spawning location 66. This is an example of how a snippet in one channel can spawn snippets in other channels. This allows the artists to control how an effect in one channel can cause a complementary effect in other channels. Note that, snippet 64*a* may then spawn additional snippets for stereo-left and (possibly other channels) but for simplicity this is not shown. Similarly, any (or all) of the other snippets in right-stereo channel could have been defined by the artists to initiate group(s) in the left or right channels, but for simplicity this is not shown. For example, if desired, each snippet in the stereo-right channel may spawn a corresponding group in the stereo-left channel, where each corresponding group contains one segment that is complementary to the stereo-right segment that spawned it.

Once all the snippets have been placed, the tracks for each channel are mixed (i.e., added together) to form the channel time samples representing the sound sequence. In the example of FIG. 6, the stereo-right channel is generated by the summation of stereo-right tracks 1, 2 and 3 (and any other stereo-right tracks spawned). Similarly, the stereo-left channel is generated by the summation of stereo-left track 1 (and any other stereo-left tracks spawned). Note the following general capabilities:

1.) A snippet may spawn any number of other groups in the same channel.

2.) A snippet in one channel can also spawn any number of groups in other channels. This allows the artist to define complementary channel effects.

3.) Spawned snippets may spawn other snippet groups in an unlimited chain.

4.) The artist can mix together any number of snippets to form each channel.

5.) The spawning location can be located anywhere within a snippet, anywhere relative to a snippet or anywhere within the composition. This provides great flexibility in placing snippets. We are not limited to simple concatenations of snippets.

6.) Any number of channels can be accommodated (for example, mono, stereo or quad).

7.) The spawning definitions may be included in the parameters defining each snippet (see FIG. 5).

Figure 7:
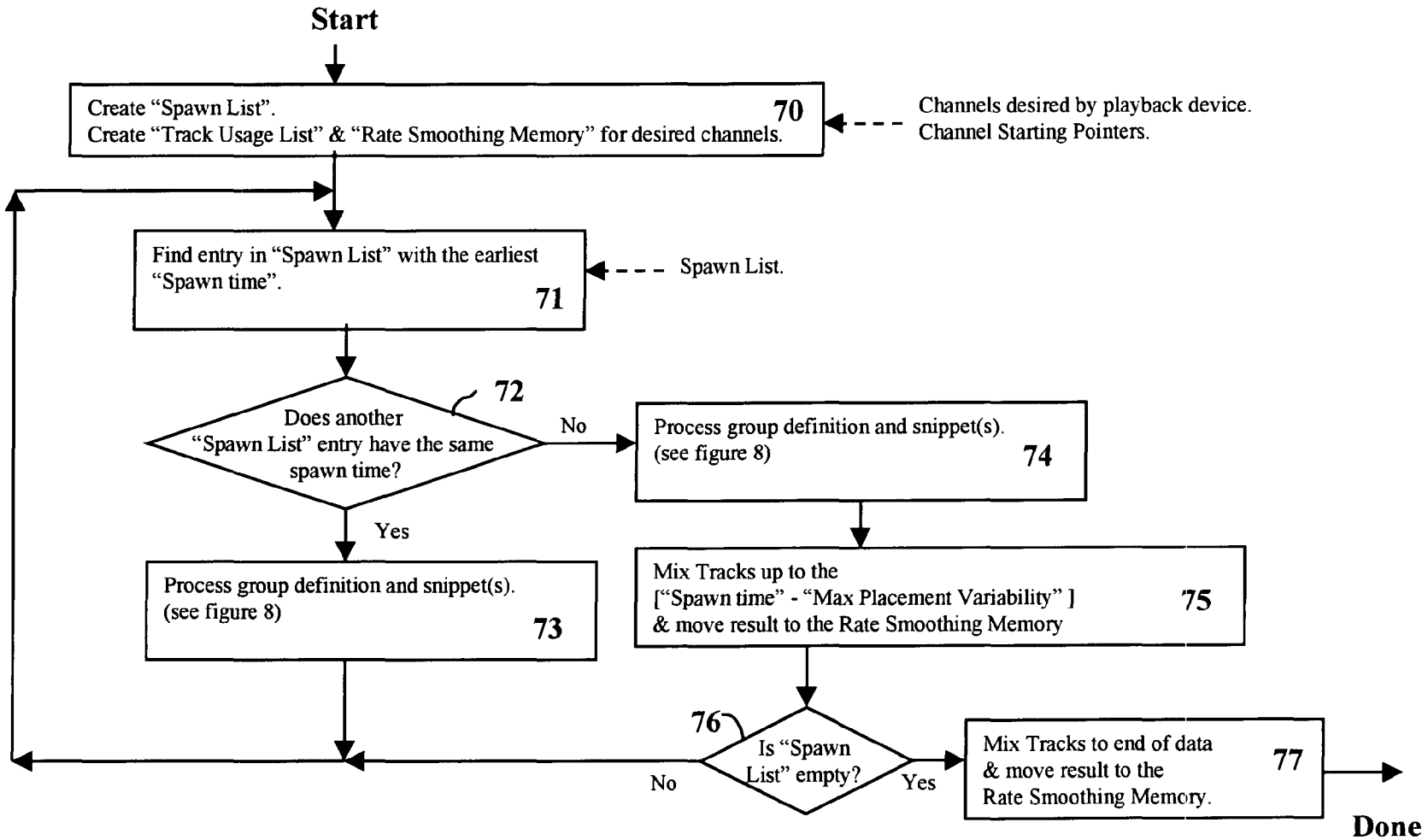
FIG. 7 is a flow diagram of the playback program.
Figure 8:
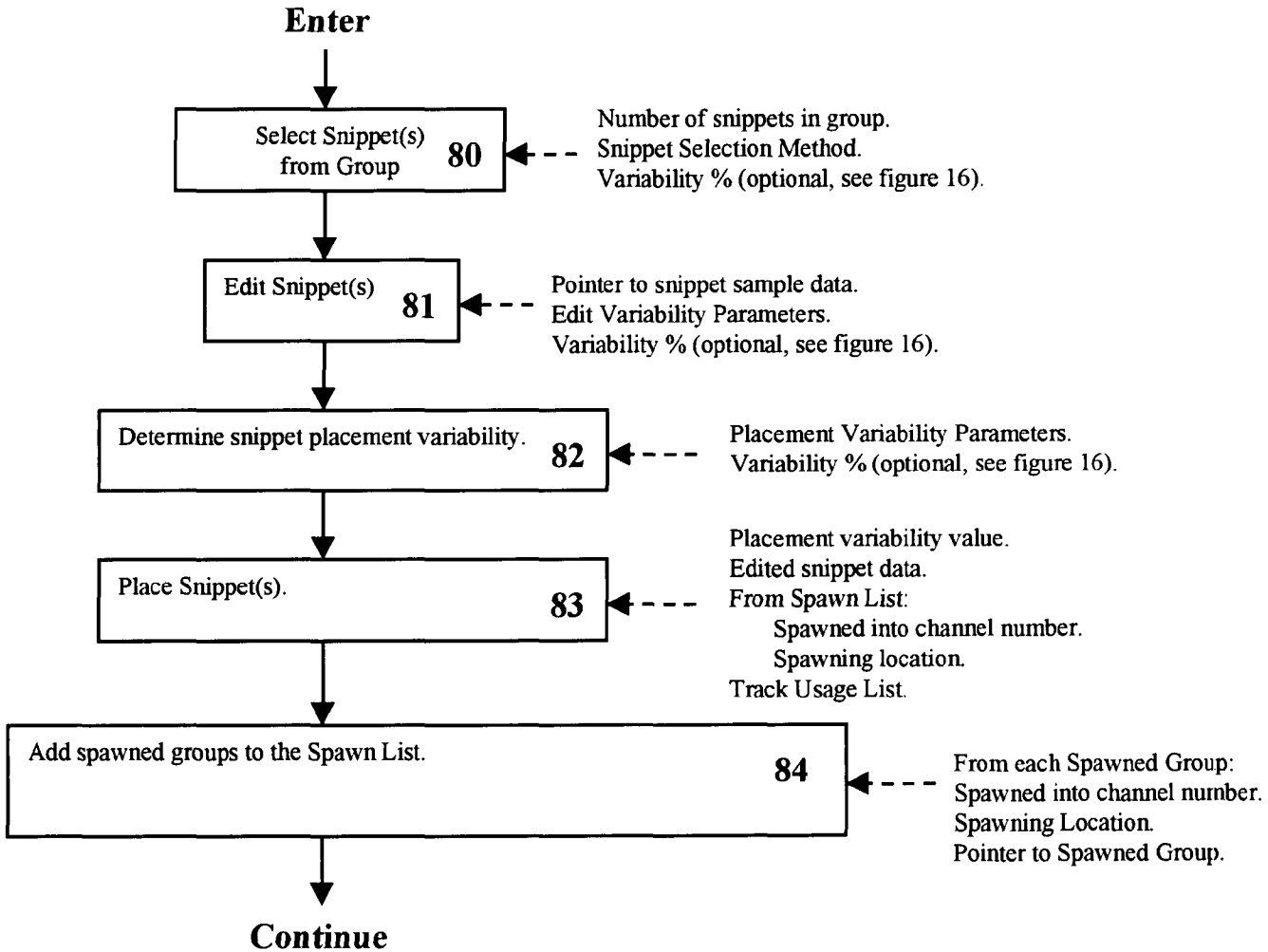
FIG. 8 is a flow diagram of the processing of a group definition and a snippet during playback.

Playback Program Flow Diagram:

A flow diagram of the playback program 24 is shown in FIG. 7. FIG. 8 provides additional detail of the "process group definition and snippet" blocks (73 and 74) of FIG. 7. The playback program processes the composition data 25 so that a different sound sequence is generated on each playback. Throughout the playback processing, working storage is utilized to hold intermediate processing results. The working storage elements are detailed in FIG. 9. This playback program is capable of handling both "pre-mixing" and "playback mixing" approaches and the simultaneous use of both approaches in a composition. If only "pre-mixing" is used, then playback program may be simplified.

Playback processing begins with the initialization block 70 shown in FIG. 7. A "Track Usage List" and a "Rate smoothing memory" are created for each of the channels desired by the playback device. For example, if the playback device is a stereo device, then a "track usage list" (90*a* & 90*b*) and "rate smoothing memory" (91*a* & 91*b*) are created for both the stereo-right and stereo-left channels. The entries in these data structures are initialized with zero or null data where required. A single "spawn list" 92 is created to contain the list of spawned groups that will need to be processed. The "spawn list" 92 is initialized with the "channel starting pointer" corresponding to the channels desired by the playback device. For example, if the playback device is a stereo device then the "spawn list" is initialized with the "stereo-right starting group" at spawning location 0 (i.e., the start).

The next step 71 is to find the entry in the spawn list with the earliest "spawning location". The group with the earliest spawning location is always processed first. This assures that earlier parts of the composition are processed before later parts.

Next a decision branch occurs depending on whether there are other "spawn list" entries with the same "spawning location". If there are other entries with the same spawning location then "process group definition and snippet" 73 is performed followed by accessing another entry in the "spawn list" via step 71.

If there are no other entries with the same spawning location then "process group definition and snippet" 74 is performed followed by mixing tracks and moving results to the rate smoothing memory 75. The tracks are mixed up to the "spawn location" minus the "max placement variability", since no following spawned groups can now be placed before this time. The "max placement variability" represents the largest shift in placement before a snippets nominal spawn location.

Step 75 is followed by a decision branch 76, which checks the "spawn list" to determine if it is empty or whether additional groups still need to be processed. If the "spawn list" still has entries, the "spawn list" is accessed again via step 71. If the "spawn list" is empty, then all snippets have been placed and step 77 can be performed, which mixes and moves the remaining data in the "track usage list" to the "rate smoothing memory". This concludes the playback of the composition.

Processing a Group Definition & Snippet (Playback Process):

FIG. 8 shows a flow diagram of the "process group definition and snippet" block 74 in FIG. 7, which is part of the playback process. In FIG. 8, the steps are shown in blocks 80 to 84, while the parameters (from the composition definition or working storage) used in each step are shown to the right of each block.

The first step 80 is to "select snippet(s) from group". The entry into this step, followed the spawning of a group at a spawning location. The selection of one or more snippets from a group is accomplished by using the number of snippets in the group and the snippet selection method. Both of these parameters were defined by the artist and are in the "group definition" in the "composition data" (FIG. 5). A typical "snippet selection method" would be to select any one of the snippets in the group with the same likelihood. But the artist may utilize other selection methods, for example, randomly selecting any "y" of the "z" segments in the group. The "Variability %" parameter is associated with an optional enhancement to the basic embodiment. Basically, the "Variability %" limits the selection of the snippets to a fraction of the group. For example if the "Variability %" is set at 60%, then the snippet selection is limited to the first 60% of the snippets in the group, chosen according to the "snippet selection method". If the "Variability %" is set at 100%, then the snippet is selected from all of the snippets in the group. If the "Variability %" is set at 0%, then only the first snippet in the group is used and the composition will default to a fixed unchanging playback. The purpose of "Variability %" and how it's set is explained in a section below.

Once snippet(s) have been selected, the next step 81 is to "edit snippet" with a variable amount of special effects such as echo, reverb, amplitude effects, etc to each snippet. The amount of special effects editing, may vary from playback to playback. The "pointer to snippet sample data" is used to locate the snippet data, while the "edit variability parameters" specify to the edit subroutine how the variable special effects will be applied to the "snippet sample data". The "Variability %" parameter functions similar to above. If the "Variability %" set to 0%, then no variable special effects editing is done. If the "Variability %" set to 100%, then the full range of variable special effects editing is done.

The next step 82 is to "determine snippet placement variability". The "placement variability parameters" are input to a placement variability subroutine to select a variation in placement of the snippet about the nominal spawning location. The placement variability for all snippets will should less then the "max placement variability" parameter defined in the setup data. The "Variability %" parameter functions similar to above. If the "Variability %" is set to 0%, then no placement variability is used. If the "Variability %" is set to 100%, then the full range of placement variability for the snippet is used.

The next step is to "place snippet" 83 into an open track for a specific channel. The channel is defined by the "spawned into channel number" shown in the "spawn list" (see FIG. 9). The placement location for the snippet is equal to the "spawning location" held in the "spawn list" plus the placement variability (if any) determined above. The usage of tracks for each channel is maintained by the "track usage list" (see FIG. 9). When a snippet is to be placed in the channel, the "track usage list" is examined for space in existing tracks. If space is not available in an existing track, another track is added to the "track usage list" and the snippet sample values are placed there.

The next step is to "add spawned groups to the spawn list" 84. The parameters in each of the spawned group definitions (58*a*, 58*p*) for the snippet are placed into the "spawn list". The "spawn list" contains the list of spawned groups that still need to be processed.

Figure 9:
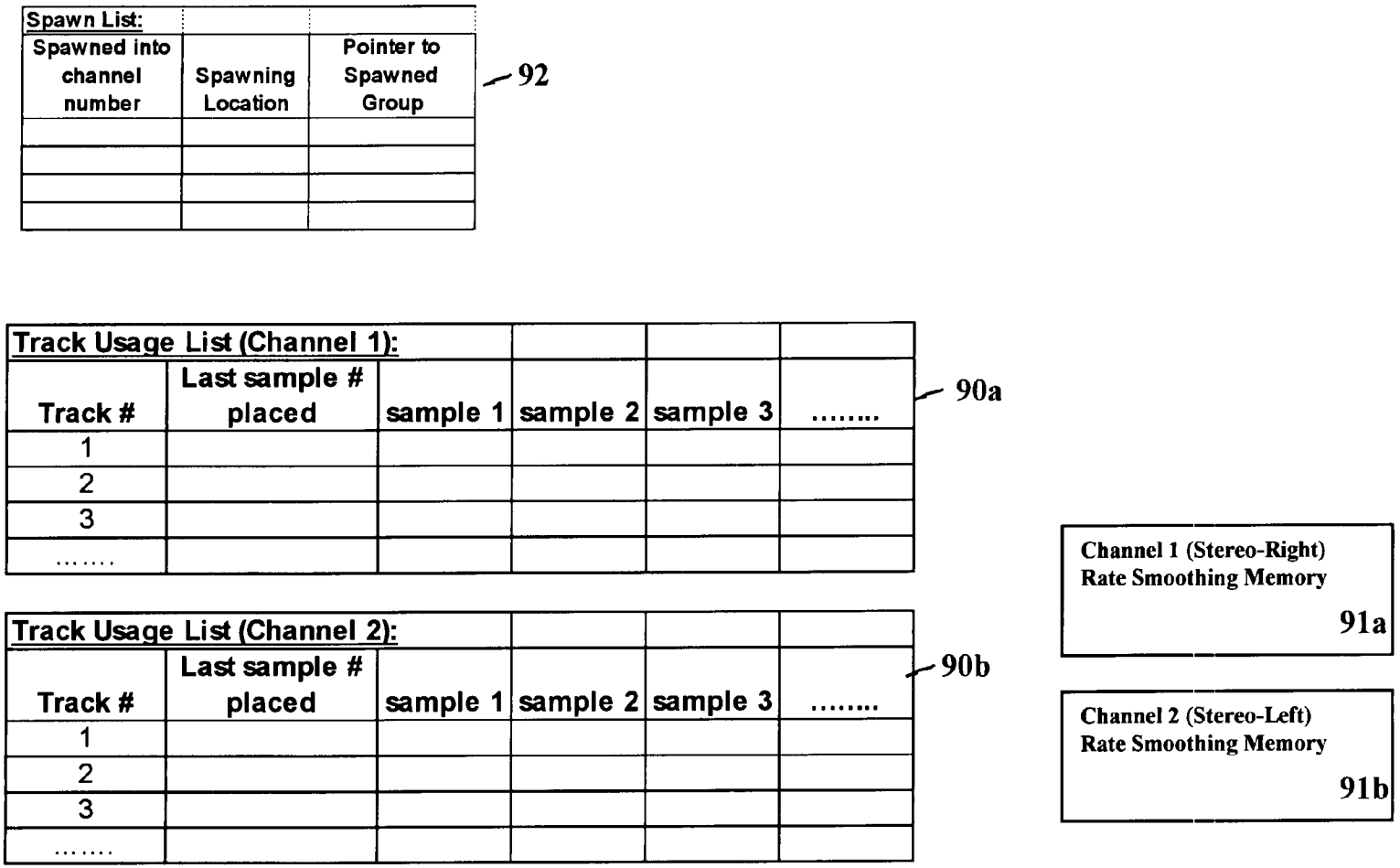
FIG. 9 is shows details of working storage used by the playback program.

Working Storage (Playback Process):

FIG. 9 shows the working storage data structures which hold intermediate processing results during the playback processing. FIG. 9 shows an example for a playback device with stereo channels. The data structures include:

1.) A "track usage list" (90*a* & 90*b*) for each channel desired by the playback device. The "track usage list" includes multiple rows of track data corresponding to the edited snippets that have been placed in time. Each row includes a "last sample # placed" to identify the next open space available in each track. A snippet is placed into an open space in an existing track. When no space is available in the existing tracks, an additional track is added to the list. The "track usage list" corresponds to the placement of edited snippets as shown in FIG. 6.

2.) A "rate smoothing memory" (91*a* & 91*b*) for each channel desired by the playback device. Mixed sound samples in time order are placed into the rate-smoothing memory in non-uniform bursts by the playback program. The output side of the rate-smoothing memory, is able to feed samples to the DAC & audio system at a uniform sampling rate.

3.) A single "spawn list" 92 used for all channels. The "spawn list" 92 holds the list of spawned groups that still need to be processed. The entry in the "spawn list" with the earliest spawning location is always processed first. This assures that groups that effect the earlier portion of a composition are processed first.

Figure 10:
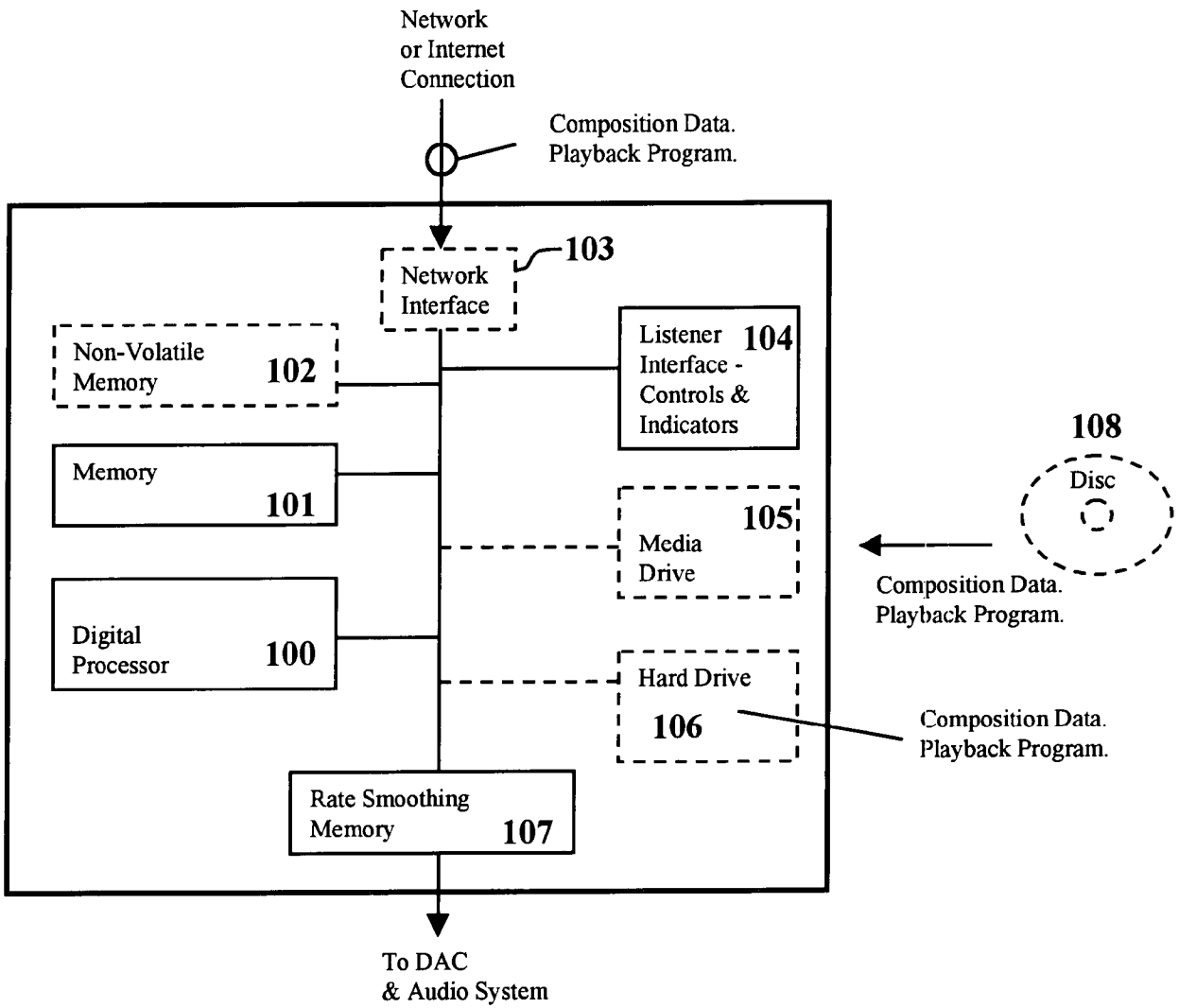
FIG. 10 is a hardware block diagram of a pseudo-live playback device.

Block Diagram of a Pseudo-Live Playback Device:

FIG. 10 shows an embodiment of a pseudo-live playback device. Each time an artist's composition is played back by the device, a unique version is generated. The playback device can be made portable and mobile if desired.

The basic elements are the digital processor 100 and the memory 101. The digital processor 100 incorporates and executes the playback program to process the composition data to generate a unique sequence of sound samples. The memory 101 may hold portions of the composition data, playback program code and working storage. The working storage includes the intermediate parameters, lists and tables (see FIG. 9) created by the playback program during the playback.

The digital processor 100 can be implemented with any digital processing hardware such as Digital processors, Central Processing Units (CPU), Digital Signal Processors (DSP), state machines, controllers, micro-controllers, Integrated Circuits (IC's) and Field Programmable Gate Arrays (FPGA's). If the processor is comprised of electronically re-configurable programmable gate array(s) [or similar], the playback program (or portions of the playback program) may be incorporated into the downloadable configuration of the gate array(s). The digital processor 100 places the completed sound samples in time order into the rate-smoothing memory 107, typically in non-uniform bursts, as samples are processed by the playback program.

The memory 101 can be implemented using random access memory, registers, register files, flip-flops, integrated circuit storage elements, and storage media such as disc, or even some combination of these.

The output side of the rate-smoothing memory 107 is able to feed samples to the DAC (digital to analog converter) & audio system at a uniform sampling rate. Sending data into the rate-smoothing memory does not interfere with the ability to provide samples at the desired times (or sampling rate) to the DAC. Possible implementations for the rate-smoothing memory 107 include a first-in first-out (FIFO) memory, a double buffer, or a rolling buffer located within the memory 101 or even some combination of these. There may be a single rate-smoothing memory dedicated to each audio output channel or the samples for the n channels can be time interleaved within a single rate-smoothing memory.

The music player includes listener interface controls and indicators 104. Besides the usual audio type controls, there may optionally be a dial or slider type control for playback variability. This control would allow the listener to adjust the playback variability % from 0% (no variability=artist defined fixed playback) to the 100% (=maximum level of variability defined by the artist). See FIG. 16 for additional details.

The playback device may optionally include a media drive 105 to allow both composition data and playback programs to be read from disc media 108 (or digital tape, etc). For the listener, operation of the playback device would be similar to that of a compact disc player except that each time an artist's composition is played back, a unique version is generated rather then the same version every time.

The playback device may optionally include a network interface 103 to allow access to the Internet, other networks or mobile type networks. This would allow composition data and the corresponding playback programs to be downloaded when requested by the user.

The playback device may optionally include a hard drive 106 or other mass storage device. This would allow composition data and the corresponding playback programs to be stored locally for later playback.

The playback device may optionally include a non-volatile memory to store boot-up data and other data locally.

The DAC (digital to analog converter) translates the digital representation of the composition's time samples into analog signals that are compatible with any conventional audio system such as audio amplifiers, equalizers and speakers. A separate DAC may be dedicated to each audio output channel.

Pseudo-Live Playback Applications:

There are many possible pseudo-live playback applications, besides the Pseudo-Live Playback Device shown in FIG. 10.

Figure 12:
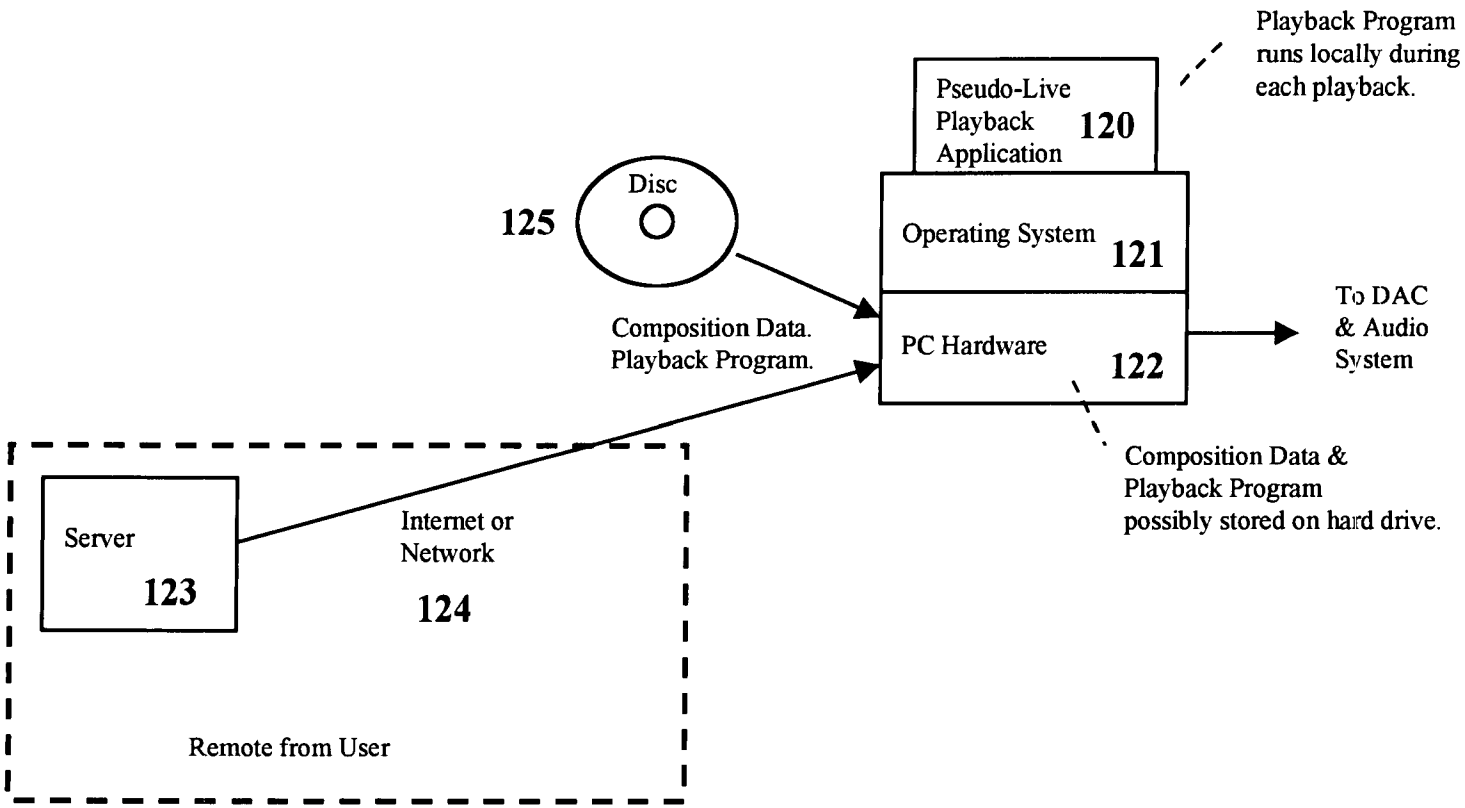
FIG. 12 shows an example of a personal computer (PC) based pseudo-live playback application (playback).

FIG. 12 shows an example of a personal computer (PC) application for playing back pseudo-live music. Here a pseudo-live playback application 120 (software program) sits above the PC operating system 121 and PC hardware 122. The composition data and playback program are provided to the PC via media (such as Disc 125 or Digital Tape) or remotely from a Server 123 over the Internet or network 124. The composition data and playback program may be optionally stored on the PC's hard drive or other media drive. The playback program is executed locally to generate a unique version of the artist's composition each playback.

Figure 13:
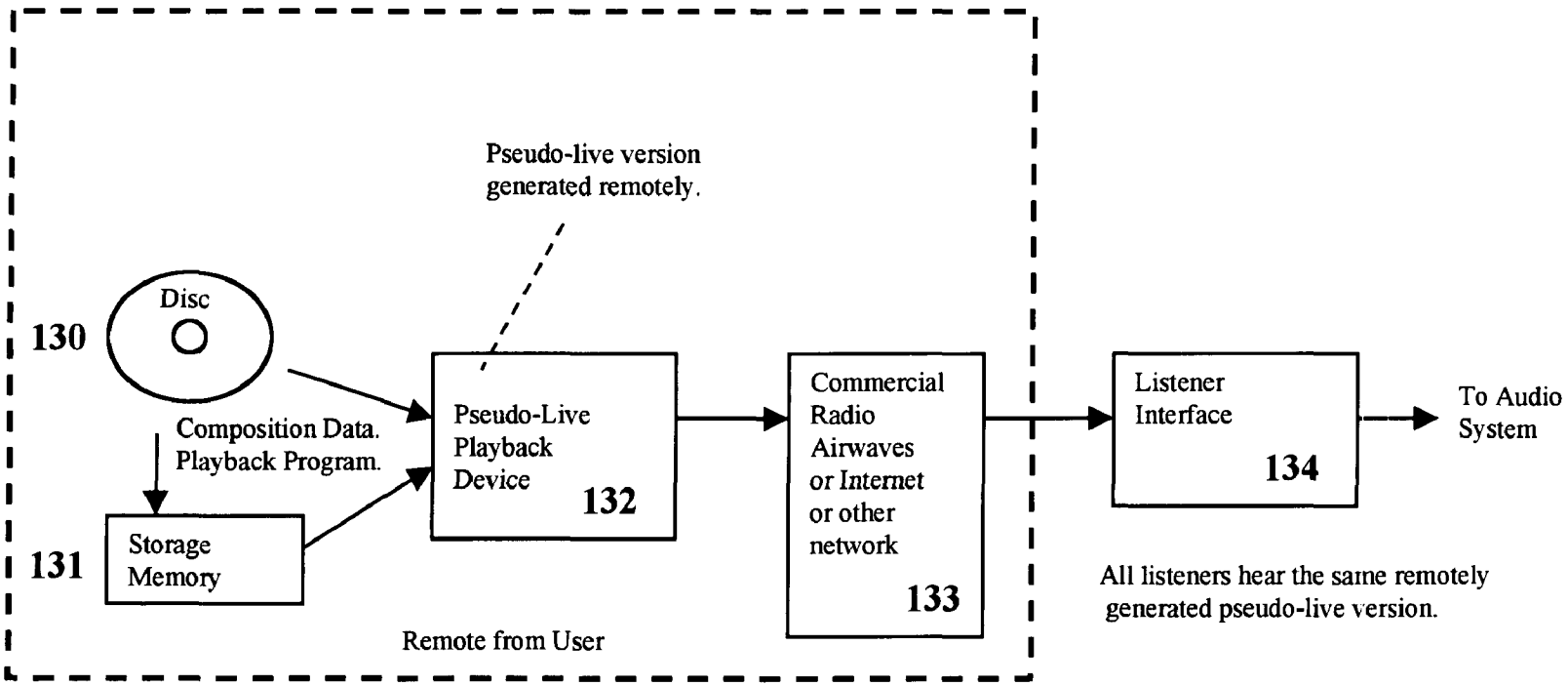
FIG. 13 shows an example of the broadcast of pseudo-live music over the commercial airwaves, Internet or other networks (playback).

FIG. 13 shows an example of the broadcast of pseudo-live music over commercial airwaves (e.g., AM or FM radio), the Internet or other networks 133. A pseudo-live playback device 132 accesses the composition data and playback program from media 130 or a storage memory 131. The playback device 132 generates a unique version of the artist's composition each playback, remotely from the listeners. The information sent to the listener may have the same format as today's static music. The pseudo-live playback version is captured by a listener's interface function 134 and then sent to the audio system. The pseudo-live music is generated remotely from the listeners. Note that on each playback, all listeners will hear the same but variable (unique) version of the artist's composition. With this configuration, note that the listener only has access to different playback versions of the composition. Since the listener does not have access to the variable composition itself, it is protected from listener piracy.

Figure 14:
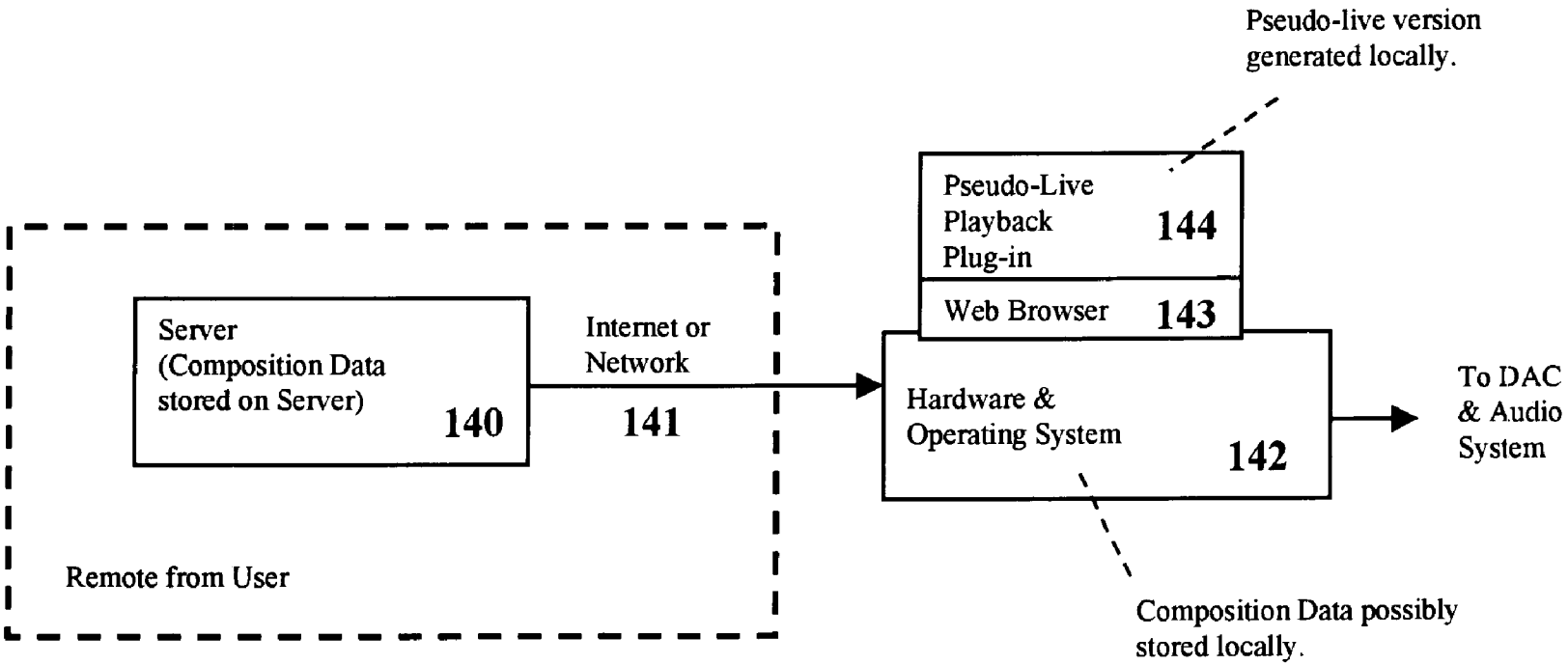
FIG. 14 shows a browser based pseudo-live music service (playback).

FIG. 14 shows an example of a web browser based pseudo-live music service. Composition data is available remotely on a server 140 and is sent to the user when requested over the Internet or other network 141. A pseudo-live playback plug-in 144, runs inside the web browser 143. The Web browser 143 runs on top of the hardware and operating system 142. Composition data may be stored locally for playback at a later time. A pseudo-live version is generated locally each time a composition is played back.

Figure 15:
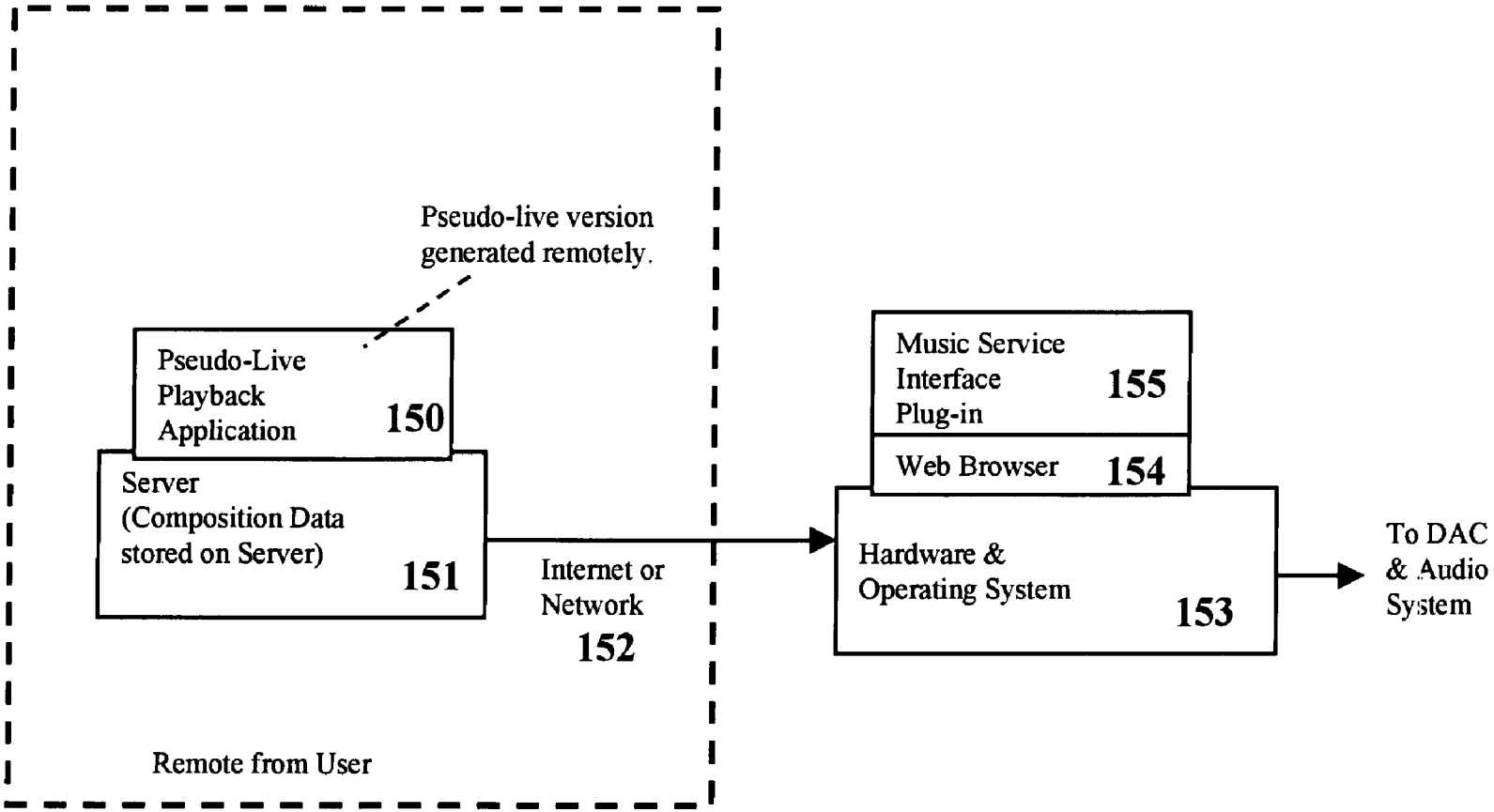
FIG. 15 shows a remote pseudo-live music service via a web browser (playback).

FIG. 15 shows an example of a remote music service via a Web browser. A pseudo-live playback application 150 is run on a remote server 151 to generate a unique pseudo-live version remotely from the user during playback. The unique playback version is sent to the listener over the Internet or another network 152. The user selects the desired composition via a music service plug-in 155 that plugs into a Web browser 154. The Web browser runs on top of the hardware and operating system 153. The pseudo-live playback program is executed remotely from the listener. The listener hears an individualized version of the artist's composition. With this configuration, note that the listener only has access to different playback versions of the composition. Since the listener does not have access to the variable composition itself, it is protected from listener piracy.

Pipelining to Shorten Delay to Music Start (Optional Playback Enhancement):

An optional enhancement to this invention's embodiment allows the music to start sooner by pipelining (i.e., streaming) the playback process. Pipelining is not required but can optionally be used as an enhancement.

Pipelining is accomplished by partitioning the composition data of FIG. 5 into time intervals. The ordering of the partitioned composition data is shown in the first row of FIG. 11, which illustrates the order that data is downloaded over a network and initialized in the processor during playback. The data order is:

1.) Playback program 24
2.) Setup data 50
3.) Interval 1 groups & snippets 110
4.) Interval 2 groups & snippets 111
5.) . . . additional interval data . . .
6.) Last Interval groups & snippets 112

Figure 11:
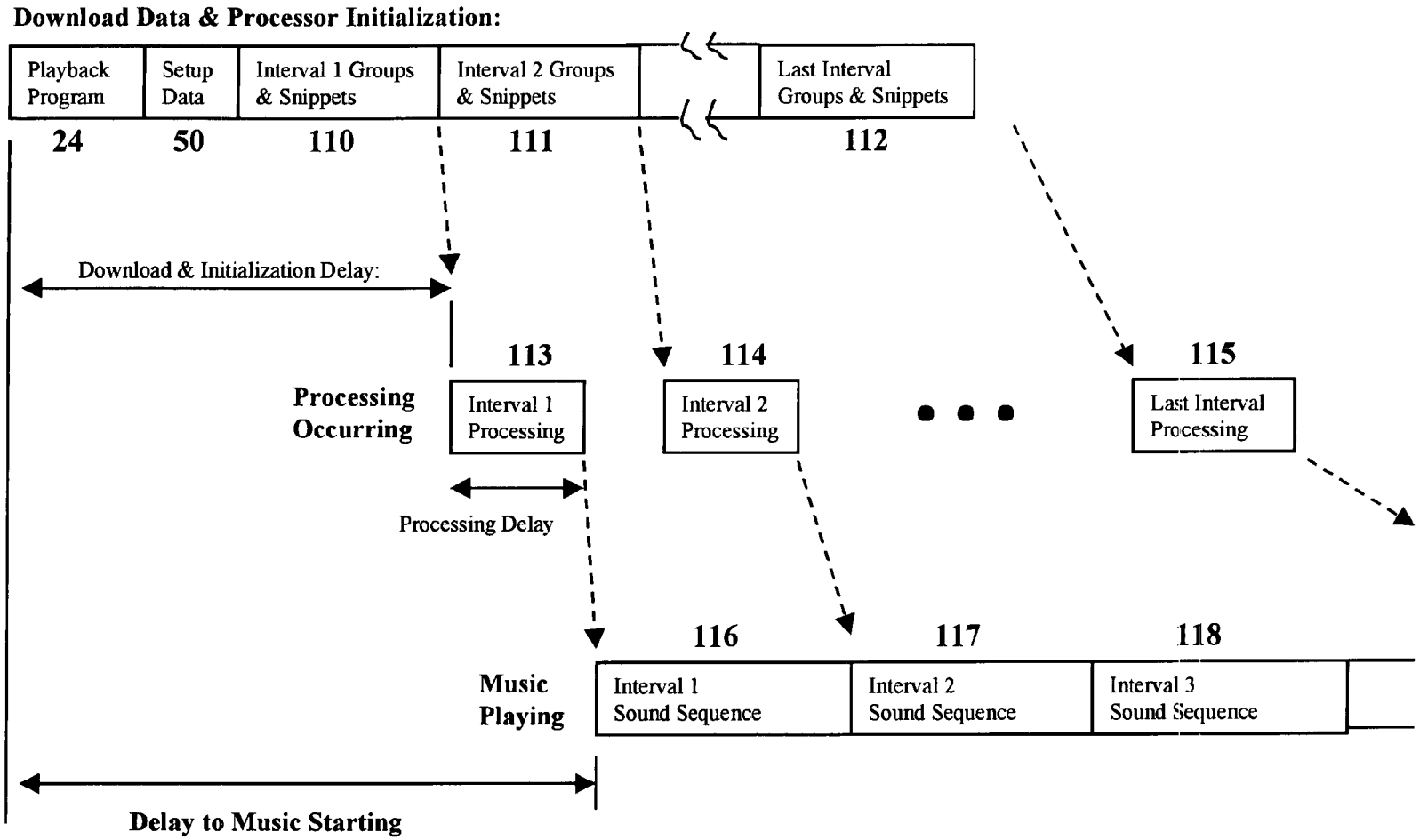
FIG. 11 shows how pipelining can be used to shorten the delay to music start (playback).

Playback processing can begin after interval 1 data is available. Playback processing occurs in bursts as shown in the second row of FIG. 11. As shown in FIG. 11, the start of processing is delayed by the download and initialization delay. Processing for each interval (113, 114 . . . 115) begins after the data for each interval becomes available.

After the interval 1 processing delay (i.e., the time it takes to process interval 1 data), the music can begin playing. As each interval is processed, the sound sequence data is placed into an output rate-smoothing memory. This memory allows the interval sound sequence data (116, 117, 118, . . . ) to be provided at a uniform sample rate to the audio system. Note that processing is completed on all desired channels before beginning processing on the next interval. As shown in FIG. 11, the total delay to music starting is equal to the download & initialization delay plus the processing delay.

Constraints on the pipelining described above are:

1.) All groups and snippets that may be needed for an interval should be provided before the processing of an interval begins.

2.) The download & initialization time of all intervals following interval 1, should be less than the sound sequence time duration of the shortest interval.

3.) The processing delay for all intervals should be less than the sound sequence time duration of the shortest interval.

Note that, any chain of snippets can be re-divided into another chain of partitioned shorter length snippets to yield an identical sound sequence. Hence, pipelining may shorten the length of snippets while it increases both the number of snippets and the number of spawned groups used. But note that, the use of pipelining, does not constrain what the artist can accomplish.

Variability Control (Optional Playback Enhancement):

An optional enhancement, not required by the basic embodiment, is a variability control knob or slider on the playback device. The variability can be adjusted by the user from between "none" (0% variability) and "max" (100% variability). At the "none" (0%) setting, all variability would be disabled and playback program will generate only the single default version defined by the artist (i.e., there is no variability from playback to playback). The default version is generated by always selecting the first snippet in every group and disabling all edit and placement variability. At the "max" (100%) setting, all the variability in the artist's composition is used by the playback program. At the "max" (100%) setting, snippets are selected from all of the snippets in each group while the full amount of the artist defined edit variability and placement variability are applied. At settings between "none" and "max", a fraction of the artist's defined variability is used, for example only some of the snippets in a group are used while snippet edit variability and placement variability would be proportionately scaled down. For example if the "Variability %" set to 60%, then the snippet selection is limited to the first 60% of the snippets in the group, chosen according to the "snippet selection method". Similarly, only 60% of the artist defined edit variability and placement variability is applied.

Another optional enhancement, not required by the basic embodiment, is an artist's specification of the variability as a function of the number of calendar days since the release of the composition (or the number of times the composition has been played). For example, the artist may define no variability for two months after the release of a composition and then gradually increasing or full variability after that. The same technique, described in the preceding paragraph, to adjust the variability between 0% and 100% could be utilized.

Figure 16:
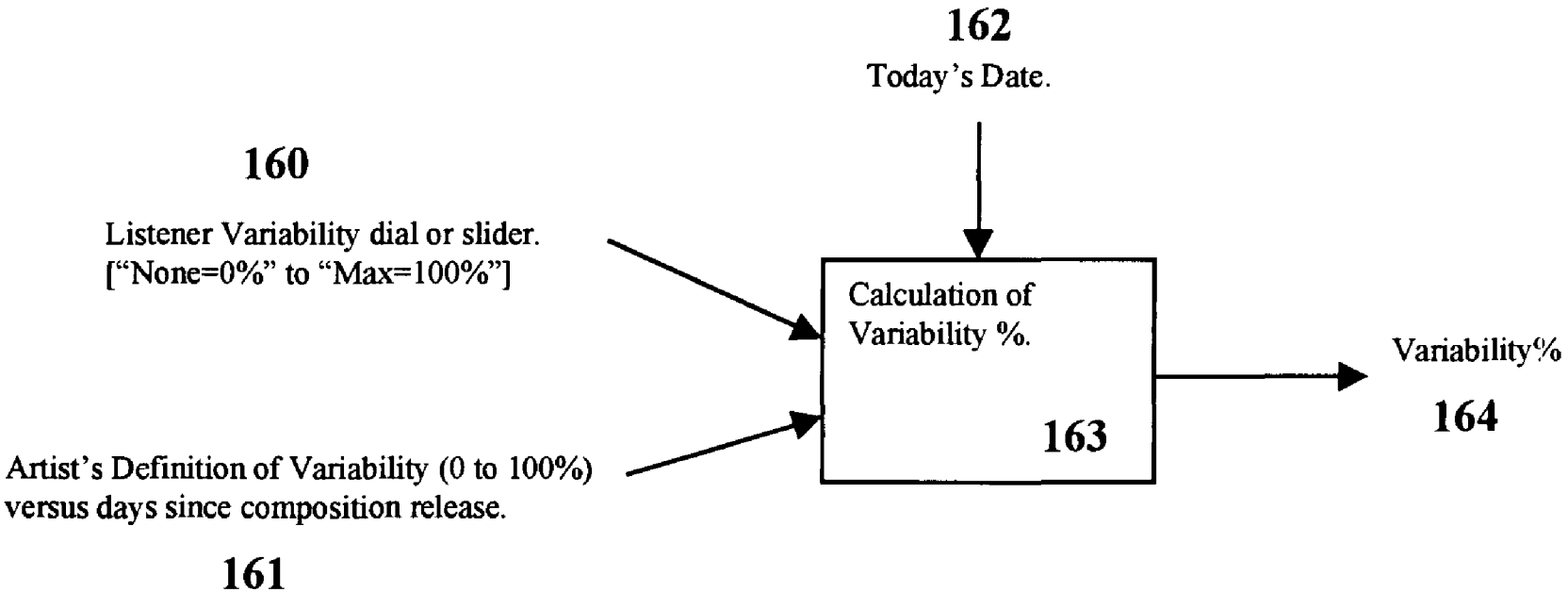
FIG. 16 shows a flow diagram for determining variability % (playback).

FIG. 16 shows a flow diagram for the generation of the Variability %. One input to this process is an encoded signal representing "none" (0%) to "max" (100%) variability from a listener variability dial or slider 160. Options for the implementation of the knob or slider include a physical control or a mouse/keyboard controlled representation on a graphical user interface. Another input to the process is the artist's definition of variability versus days since composition release 161. This definition would be included in the setup data fields of the composition data (see FIG. 5). A third input to this process is Today's date 162. Using these inputs, the "Calculation of Variability %" 163 generates the "Variability %" 164.

Using Sound Segments Defined by a Command Sequence (Such as MIDI):

A sound segment may also be defined in other ways then just digitized samples of sound. For example, a sound segment may also be defined by a sequence of commands to instruments (or software virtual instruments) that can generate a particular sound segment. An example, is a sound segment defined by a sequence of MIDI-type commands to control one or more instruments that will generate the sound sequence. For example, a MIDI-type sequence of commands that generate a piano sound segment. Or a MIDI-type sequence of commands that generate a sound segment containing multiple instruments.

If artists desire, both digitized sound segments and MIDI-type sound segments may be used in the same variable composition. Any fraction of the composition sound segments may be MIDI-type sound segments, from none to all of the segments in the composition. If desired, a group may contain all MIDI-like sound segments or a combination of MIDI-like sound segments and other sound segments.

An advantage of using MIDI-like sound segments is that the amount of data needed to describe a MIDI-like sound sequence is typically much less than that required for a digitized sampled sound segment. A disadvantage of using a MIDI-like sound segment is that each MIDI-like sequence must be converted into a digitized sound segment or segments before being combined with the other segments forming the variable composition. A more capable playback device is required since it must also incorporate the virtual MIDI instruments (software) to convert each selected MIDI-like sequence to a digitized sample sound sequence.

MIDI-like segments have the same initiation capabilities as other sound segments. As with other sound segments in a variable composition, each MIDI-like sound segment may have zero, one or more spawning definitions associated with it. Similarly, each spawn definition identifies one group of sound segments and a group insertion time. The spawning of a group and processing of the selected segment(s) occurs in the same manner as with other sound segments. The artists may define a group to be spawned anywhere relative to the MIDI-like sound segment that spawns it (i.e., not limited to spawning just at the MIDI-like segment boundaries). The only difference during playback is that when a MIDI-like sound segment is selected it must first be converted into a digitized sample sound segment before it is combined with the other segments during playback.

The variable composition creation process does not significantly change when MIDI-like segments are used. Many instruments are capable of generating a MIDI or MIDI-like command sequence at an output interface. The MIDI-like sequence reflects what actions the artist performed while playing the instrument. The composition creation software would be capable of capturing these MIDI-like command sequences and able to locate the MIDI-like segments relative to other composition segments. For those instruments that the artist defines, the MIDI-like sequences are captured instead of a digitally sampled sound segment. There may be means for visually indicating where each MIDI-like segment is located relative to other composition segments. The playback alternatives may be created and defined by the artists in a manner similar to the way other alternative segments are created. The formation of groups for playback occurs in a similar manner. The composition format is modified to include the MIDI-like (command sequence) sound segments. The playback program would incorporate or access the virtual MIDI instruments (software), so each selected MIDI-like sound segment can be converted into a digitally sample sound segment, during playback, before being combined with other sound segments.

Other Optional Playback Enhancements:

Other optional enhancements, not required by the basic embodiment are:

1.) Execution of the playback program code within a security protected virtual machine in order to protect the playback device and it's files from corruption caused by the execution of a malicious software program.

2.) Performing variable inter-segment special effects editing during playback processing. Inter-segment effects allow a complementary effect to be applied to multiple related segments. For example, an special effect in one channel also causes a complementary effect in the other channel(s) or in other segments. An example of inter-channel variability effect is a variable stereo panning effect (right/left channel amplitude shifting). This can be accomplished by the addition of a few parameters into the snippet parameters 56. An inter-segment edit flag would be added to each of the spawned groups 58*a* through 58*p*. When the flag is set, it signals that the selected segment from the group, is to be inter-segment edited with the other spawned groups (58*a*-58*p*) that have the flag set. The inter-segment edit parameters needed by the inter-segment processing subroutine would be added to the edit variability parameters located in block 57.

3.) Encryption methods may be used to protect against the unauthorized use of the artist's snippets.

Disadvantages and How to Overcome:

The left column of the table in FIG. 17, lists the disadvantages of pseudo-live music compared with the conventional "static" music of today's recording industry. The right column in the table indicates how each of these disadvantages can be overcome with the continuous rapid advancement and decreasing cost of digital technologies. The currently higher cost of pseudo-live music, compared with "static" music, will become increasingly smaller and eventually insignificant in the near future.

Alternative Uses of this Invention:

Although not a primary objective, this invention may also be used, as a form of data compression, to reduce the amount of composition data by re-using sound segments throughout a playback. For example, the same rum beat (or any other parts) could be re-used multiple times. But the artists should carefully consider the impact of such re-use on the listeners experience.

Although the above discussion is directed to the creation and playback of music and audio by artists, it may also be easily applied to any other type of sound, audio, language instruction, sound effects, musical instruments, demo modes for instruments, music videos, videos, multi-media creations, and variable MIDI-like compositions.

I claim:

1. A method for generating music or sound, comprising:

providing at least one group of alternative sound segments;

providing at least one initiating sound segment, wherein an initiating sound segment designates one or more of said groups;

processing said sound segments such that responsive to selection of an initiating sound segment, a subset of the sound segments in said at least one group designated by the initiating segment is selected and used to generate a sound sequence; wherein said selection of segments from a group varies each time said processing is initiated;

whereby the generated sound sequence can vary each time said processing is initiated.

2. A method as in claim 1 wherein said processing further includes: combining a selected alternative segment with an initiating segment in a sound channel.

3. A method as in claim 1 wherein during said processing, at least one alternative segment overlaps at least part of an initiating segment or another segment, in the same channel; wherein the overlapping portions of the segments in the same sound channel will be mixed together.

4. A method as in claim 1 further including: providing a rate-buffer wherein said processing provides digital samples to the input side of said rate-buffer at a non-uniform rate; while the output side of said rate-buffer provides digital samples to an output sound channel at a substantially uniform rate.

5. A method as in claim 1 wherein said selecting of a subset of the segments in a group, includes selecting "y" segments from the "z" segments in a group, wherein the numbers "y" or "z" can be fixed or can vary each time a subset is selected from a group or each time said processing is initiated.

6. A method as in claim 1 further including: providing placement locations for said sound segments, wherein said placement locations were defined on a visual display.

7. A method as in claim 1 further including: providing placement-locations associated with said sound segments or said groups; wherein during said processing, sound segments are utilized at said placement locations.

8. A method as in claim 1 wherein at least one segment selected from a group is utilized in a different sound channel from its initiating segment; whereby the generated sound sequence can vary in a plurality of sound channels.

9. A method as in claim 1 further including: providing placement-locations associated with said sound segments or said groups, wherein said placement-locations occur in a plurality of sound channels; wherein during said processing, sound segments are utilized at said placement-locations in a plurality of channels; whereby the generated sound sequence can vary in a plurality of sound channels.

10. A method as in claim 1 wherein, during said processing, some of said initiating or alternative sound segments are automatically generated, by variable effects editing of another sound segment.

11. A method as in claim 1 wherein, during said processing, some of said initiating or alternative sound segments are automatically generated, from a time sequence of instrument note parameters or MIDI-like commands.

12. A method as in claim 1 further including:

providing a playback program or playback processor;

providing a dataset incorporating said initiating and alternative segments, wherein said dataset is separately packaged from said playback program or playback processor;

wherein, during said processing, said dataset is processed by said playback program or playback processor to generate a sound sequence; whereby said playback program or playback processor can be compatible with a plurality of datasets representing different sound compositions or compositions from different artists.

13. A method as in claim 1 wherein some sound segments were created by the artist, substantially simultaneously with the artist creating or listening to other segments.

14. A method as in claim 1 wherein some sound segments were created by the artist by mixing together tracks; wherein some of said tracks were created, substantially simultaneously with the artist creating or listening to other tracks or sound segments.

15. A method as in claim 1 wherein some of said segments are provided across the Internet or a network.

16. A method as in claim 1 wherein the number of segments available for selection from a group, in a given playback, varies in response to the calendar time or number of times the composition has been played by a user.

17. A method for generating music or sound, comprising:

providing a playback program or playback processor;

providing a dataset packaged separately from said playback program or playback processor; wherein said dataset incorporates:

at least one foundation sound segment;

at least one group of alternative sound segments, wherein some of said alternative sound segments at least partially overlap a foundation sound segment;

placement locations for said sound segments;

processing said dataset with said playback program or playback processor to generate a sound sequence, by automatically selecting a varying subset of said alternative sound segments, and combining some of the selected alternative sound segments with said at least one foundation sound segment, wherein sound segments that overlap in a same sound channel are mixed together;

whereby the generated sound sequence can vary each time said processing is initiated.

18. A method as in claim 17 wherein said placement locations of said sound segments were defined on a visual display.

19. A method as in claim 17 wherein said placement locations are defined in a plurality of sound channels; wherein during said processing, said segments are utilized in a plurality of sound channels; whereby the generated sound sequence can vary in a plurality of sound channels.

20. A method as in claim 17 wherein said dataset further includes at least one definition of how a subset of the segments in said at least one group are to be variably selected during processing.

21. A method as in claim 17 wherein said dataset further incorporates at least one initiating sound segment, wherein an initiating sound segment designates one or more of said groups, wherein during said processing, responsive to selection of an initiating sound segment, a subset of the sound segments in said at least one group designated by the initiating segment is selected and used to generate a sound sequence; wherein said selection of segments from a group varies each time said processing is initiated.

22. A method as in claim 17 wherein at least some of said foundation or overlapping sound segments were created substantially simultaneously with creating or listening to a foundation sound segment.

23. A method as in claim 17 wherein at least some of said foundation or overlapping sound segments were created by mixing together tracks, and wherein some of said tracks were created, substantially simultaneously with creating or listening to other tracks or sound segments.

24. A method as in claim 17 wherein, during said processing, some of said foundation or alternative sound segments are automatically generated, from a time sequence of instrument note parameters or MIDI-like commands.

25. A method as in claim 17 wherein said playback program or playback processor is compatible with a plurality of different datasets representing different sound compositions or compositions from different artists.

26. A method for generating music or sound, comprising:

providing at least one foundation sound segment and a plurality of alternative sound segments, wherein some of said alternative sound segments at least partially overlap a foundation sound segment, wherein the location of said foundation sound segments and alternative sound segments were defined on a visual display;

processing said segments by automatically selecting and using a varying subset of said alternative sound segments, wherein some of the alternative sound segments that are selected during playback are combined with said foundation sound segment or segments, wherein sound segments that overlap in a same sound channel are mixed together;

whereby the generated sound sequence can vary each time said processing is initiated.

27. A method as in claim 26 wherein said segment locations are defined in a plurality of sound channels, whereby the generated sound sequence can vary in a plurality of sound channels.

28. A method as in claim 26 further including: providing at least one group of alternative sound segments; wherein, said during processing, a subset of the segments in said at least one group are variably selected and used to generate a sound sequence.

29. A method as in claim 26 wherein said sound segments are incorporated in a dataset; wherein said dataset is separate from a playback program or playback processor; wherein, during said processing, said dataset is automatically processed by said playback program or playback processor; whereby said playback program or playback processor can be compatible with a plurality of datasets representing different sound compositions or compositions from different artists.

30. A method as in claim 26 wherein some of said sound segments were created by recording or combining sound segments or by special effects editing other sound segments.

31. A method as in claim 26 wherein at least some of said foundation or overlapping sound segments were created substantially simultaneously with creating or listening to a foundation sound segment.

32. A method as in claim 26 wherein at least some of said foundation or overlapping sound segments were created by mixing together tracks, and wherein some of said tracks were created by the artist, substantially simultaneously with creating or listening to other tracks or sound segments.

33. A method as in claim 26 wherein, during said processing, some of said foundation or alternative sound segments are automatically generated, from a time sequence of instrument note parameters or MIDI-like commands.

34. A method as in claim 26 wherein, during said processing, some of said sound segments are automatically generated by variable effects editing of another sound segment.

35. A method as in claim 26 further including: providing at least one initiating sound segment, wherein an initiating sound segment designates at least one group of alternative sound segments; wherein during said processing, responsive to selection of an initiating sound segment, a subset of the alternative sound segments in said at least one group designated by the initiating segment is selected and used to generate a sound sequence; wherein said selection of segments from a group varies each time said processing is initiated.

36. A method for generating music or sound, comprising:

providing a plurality of alternative sound segments, wherein at least some of said alternative sound segments were created substantially simultaneously with creating or listening to a foundation sound segment;

processing said selected alternative sound segments to generate a sound sequence, by automatically selecting and using a subset of said alternative sound segments during each playback, wherein said selecting is variable each time said processing is initiated;

whereby the generated sound sequence can vary each time said processing is initiated.

37. A method as in claim 36 wherein during said processing; some of said selected alternative segments are combined with said foundation segment or segments.

38. A method as in claim 36 wherein at least one segment overlaps another segment in the same sound channel; wherein, during said processing, segments that overlap in the same sound channel are mixed together.

39. A method as in claim 36 further including: providing segment placement locations defined in a plurality of sound channels, whereby the generated sound sequence can vary in a plurality of sound channels.

40. A method as in claim 36 further including: providing at least one group of said alternative sound segments; wherein, during said processing, a subset of the segments in said at least one group are variably selected and used to generate a sound sequence.

41. A method as in claim 36 further including: providing at least one initiating sound segment, wherein an initiating sound segment designates at least one group of said alternative sound segments; wherein during said processing, responsive to selection of an initiating sound segment, a subset of the sound segments in said at least one group designated by the initiating segment is selected and used to generate a sound sequence; wherein said selection of segments from a group varies each time said processing is initiated.

42. A method as in claim 36 further including: providing placement locations for said sound segments; wherein said placement locations were defined on a visual display; wherein, during said processing, said segments are used at their placement locations.

43. A method as in claim 36 wherein, during said processing, some of said sound segments are automatically generated by variable effects editing of another sound segment.

44. A method as in claim 36 wherein, during said processing, some of said foundation or alternative sound segments are automatically generated, from a time sequence of instrument note parameters or MIDI-like commands.

45. A method as in claim 36 wherein said sound segments are incorporated in a dataset; wherein said dataset is separate from a playback program or playback processor; wherein, during said processing, said dataset is automatically processed by said playback program or playback processor; whereby said playback program or playback processor can be compatible with a plurality of datasets representing different sound compositions or compositions from different artists.

46. A method for generating music or sound, comprising:

providing at least one group comprising a plurality of alternative mixed sound segments; wherein said alternative mixed sound segments are created by:

providing at least one foundation sound segment, providing a plurality of overlaying sound segments, wherein an overlaying sound segment at least partially overlays a foundation sound segment;

mixing together different subsets of said overlaying sound segments with a foundation sound segment or segments, to create a plurality of alternative mixed sound segments representing different playback versions;

processing said alternative mixed sound segments to form a sound sequence by selecting at least one of said plurality of alternative mixed sound segments from said at least one group; wherein said selecting of a mixed sound segment is variable each time said processing is initiated whereby the generated sound sequence can vary each time said processing is initiated.

47. A method as in claim 46 wherein, during said processing, one alternative mixed sound segment is variably selected from a group of alternative mixed sound segments to generate a sound channel.

48. A method as in claim 46 wherein there is one group of alternative mixed sound segments for a sound channel; wherein, during said processing, one sound segment is variably selected from said one group of alternative mixed sound segment to generate a sound channel.

49. A method as in claim 46 wherein, during said processing, one alternative mixed sound segment is variably selected from a group of alternative mixed sound segments and concatenated to another sound segment.

50. A method as in claim 46 wherein, during said creating; locations of some of said foundation or overlaying sound segments were defined on a visual display.

51. A method as in claim 46 wherein, during said creating; at least some of said foundation or overlaying sound segments were created substantially simultaneously with creating or listening to a foundation sound segment.

52. A method as in claim 46 wherein, during said creating; some of said foundation or overlaying sound segments were created by mixing together tracks, and wherein some of said tracks were created, substantially simultaneously with creating or listening to other tracks or sound segments.

53. A method as in claim 46 wherein, during said creating; some of said foundation or overlaying sound segments were created by special effects editing of another sound segment or segments.

54. A method as in claim 46 wherein said at least one group of alternative mixed sound segments are incorporated in a dataset; wherein said dataset is separate from a playback program or playback processor; wherein, during said processing, said dataset is automatically processed by said playback program or playback processor; whereby said playback program or playback processor can be compatible with a plurality of datasets representing different sound compositions or compositions from different artists.

55. A method as in claim 46 further including:

providing at least one initiating sound segment, wherein an initiating sound segment designates at least one group of alternative mixed sound segments;

wherein during said processing; responsive to selection of an initiating sound segment, a mixed sound segment is selected from a group designated by the initiating segment; wherein the selected mixed sound segment is concatenated to its initiating sound segment.

* * * * *